US007714813B2

(12) United States Patent
Uchino et al.

(10) Patent No.: US 7,714,813 B2
(45) Date of Patent: May 11, 2010

(54) PIXEL CIRCUIT, DISPLAY DEVICE, AND METHOD FOR DRIVING PIXEL CIRCUIT

(75) Inventors: Katsuhide Uchino, Kanagawa (JP); Junichi Yamashita, Tokyo (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 768 days.

(21) Appl. No.: 10/558,372

(22) PCT Filed: Jun. 3, 2004

(86) PCT No.: PCT/JP2004/008055

§ 371 (c)(1),
(2), (4) Date: Dec. 7, 2006

(87) PCT Pub. No.: WO2004/109639

PCT Pub. Date: Dec. 16, 2004

(65) Prior Publication Data

US 2007/0120795 A1 May 31, 2007

(30) Foreign Application Priority Data

Jun. 4, 2003 (JP) ..... 2003-159646

(51) Int. Cl.
*G09G 3/30* (2006.01)

(52) U.S. Cl. ..... 345/77; 345/691; 315/291

(58) Field of Classification Search ..... 345/76–77, 345/80, 82–83, 204–206, 691; 315/169.3, 315/291

See application file for complete search history.

(56) References Cited

U.S. PATENT DOCUMENTS 6,229,506 B1 5/2001 Dawson et al.

(Continued)

FOREIGN PATENT DOCUMENTS

JP 2002-514320 5/2002

(Continued)

OTHER PUBLICATIONS

U.S. Appl. No. 10/557,800, filed Nov. 18, 2005, Uchino et al.

(Continued)

*Primary Examiner*—Amr Awad
*Assistant Examiner*—Stephen A Bray
(74) *Attorney, Agent, or Firm*—Oblon, Spivak, McClelland, Maier & Neustadt, L.L.P.

(57) ABSTRACT

A pixel circuit, display device, and method of driving a pixel circuit enabling source-follower output with no deterioration of luminance even with a change of the current-voltage characteristic of the light emitting element along with elapse, enabling a source-follower circuit of n-channel transistors, and able to use an n-channel transistor as a drive transistor of a light emitting element while using current anode-cathode electrodes, wherein a capacitor C111 is connected between a gate and source of a TFT 111 as a drive transistor, a source side of the TFT 111 is connected to a fixed potential (for example GND) through the TFT 114, the gate and drain of the TFT 111 are connected through the TFT 113 to cancel the threshold value Vth, the threshold value Vth is charged in the capacitor C111, and the input voltage Vin is coupled with the gate of the TFT 111 from the threshold voltage Vth.

12 Claims, 37 Drawing Sheets

U.S. PATENT DOCUMENTS

| | | | | |
|---|---|---|---|---|
| 6,680,580 | B1 * | 1/2004 | Sung | 315/169.3 |
| 6,777,888 | B2 * | 8/2004 | Kondo | 315/169.3 |
| 7,612,749 | B2 * | 11/2009 | Libsch et al. | 345/82 |
| 2003/0103022 | A1 * | 6/2003 | Noguchi et al. | 345/77 |
| 2003/0112208 | A1 * | 6/2003 | Okabe et al. | 345/82 |
| 2004/0017162 | A1 * | 1/2004 | Sato et al. | 315/169.3 |
| 2004/0257353 | A1 * | 12/2004 | Imamura et al. | 345/204 |

FOREIGN PATENT DOCUMENTS

| | | |
|---|---|---|
| JP | 2003-43993 | 2/2003 |
| JP | 2003-122306 | 4/2003 |
| JP | 2003-150106 | 5/2003 |
| JP | 2003-223138 | 8/2003 |
| WO | 02/075709 | 9/2002 |

OTHER PUBLICATIONS

James L. Sandford, et al., "4.2: TFT AMOLED Pixel Circuits and Driving Methods", 2003 SID International Symposium, vol. XXXIV, XP-007008187, May 20, 2003, pp. 10-13.

* cited by examiner

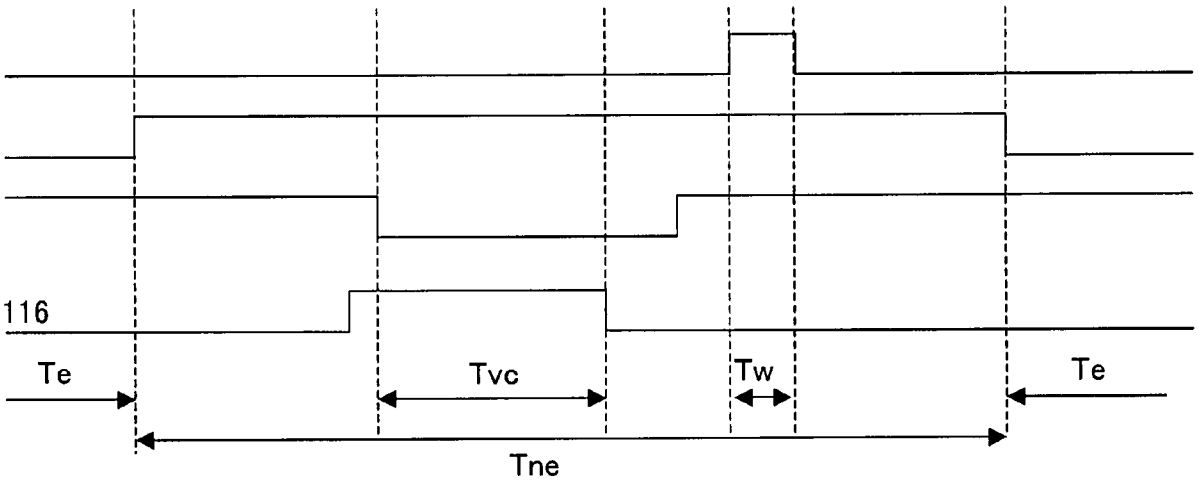
FIG. 10A ws[1]: TFT115
FIG. 10B ds[1]: TFT114
FIG. 10C ds[2]: TFT112
FIG. 10D az[1]: TFT113,116

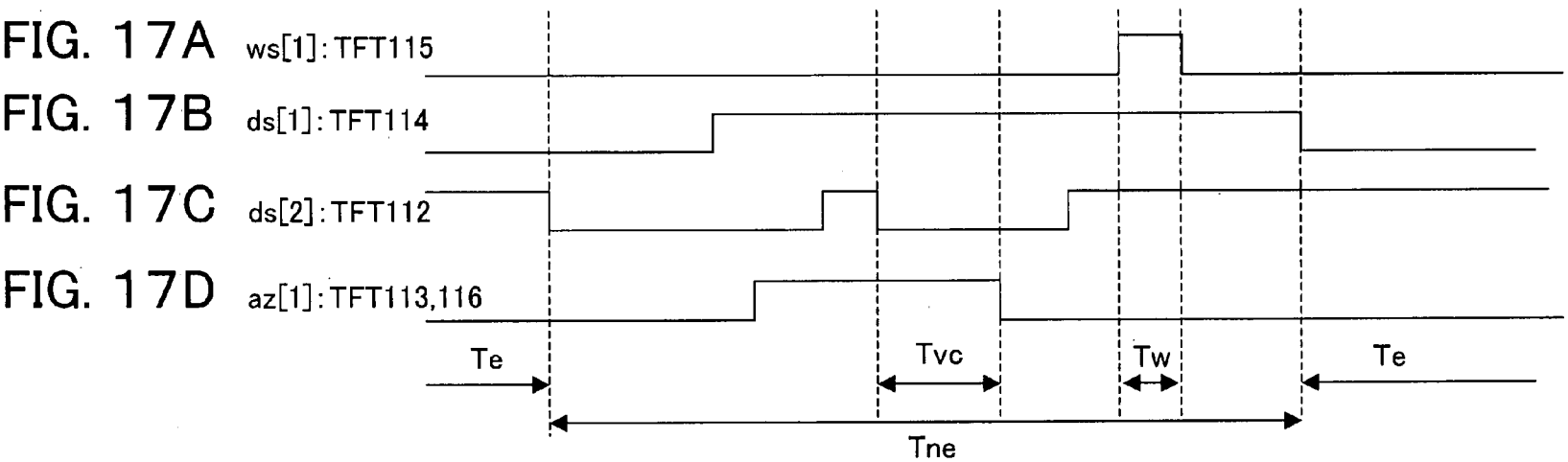
FIG. 17A ws[1]: TFT115
FIG. 17B ds[1]: TFT114
FIG. 17C ds[2]: TFT112
FIG. 17D az[1]: TFT113,116
Te
Tvc
Tw
Te
Tne

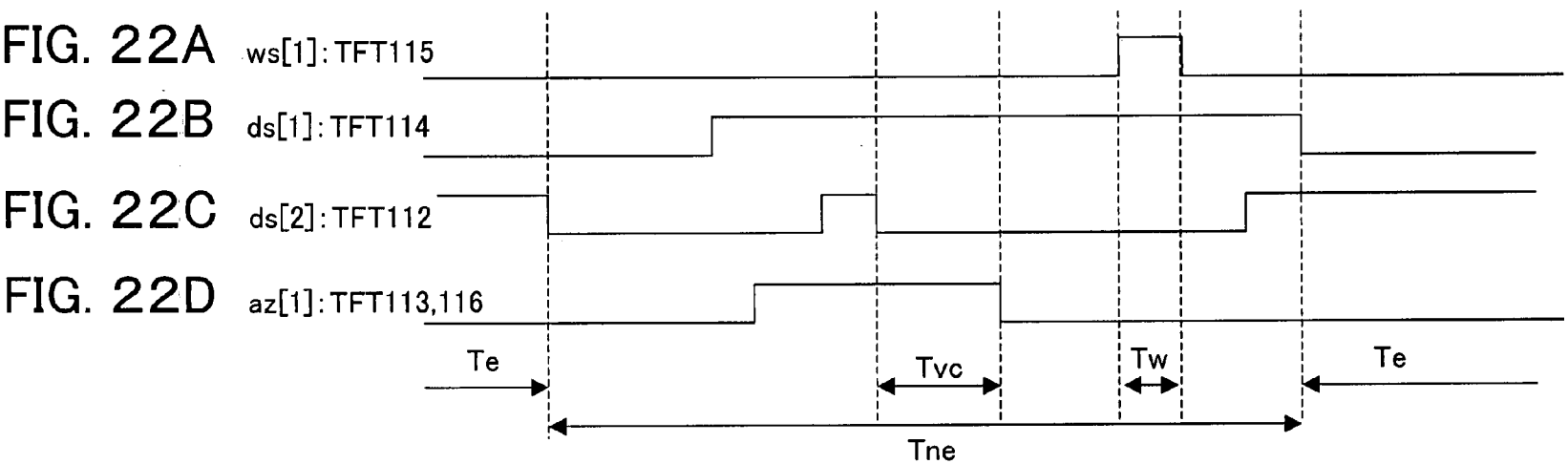
FIG. 22A ws[1]: TFT115
FIG. 22B ds[1]: TFT114
FIG. 22C ds[2]: TFT112
FIG. 22D az[1]: TFT113,116
Te
Tvc
Tw
Te
Tne

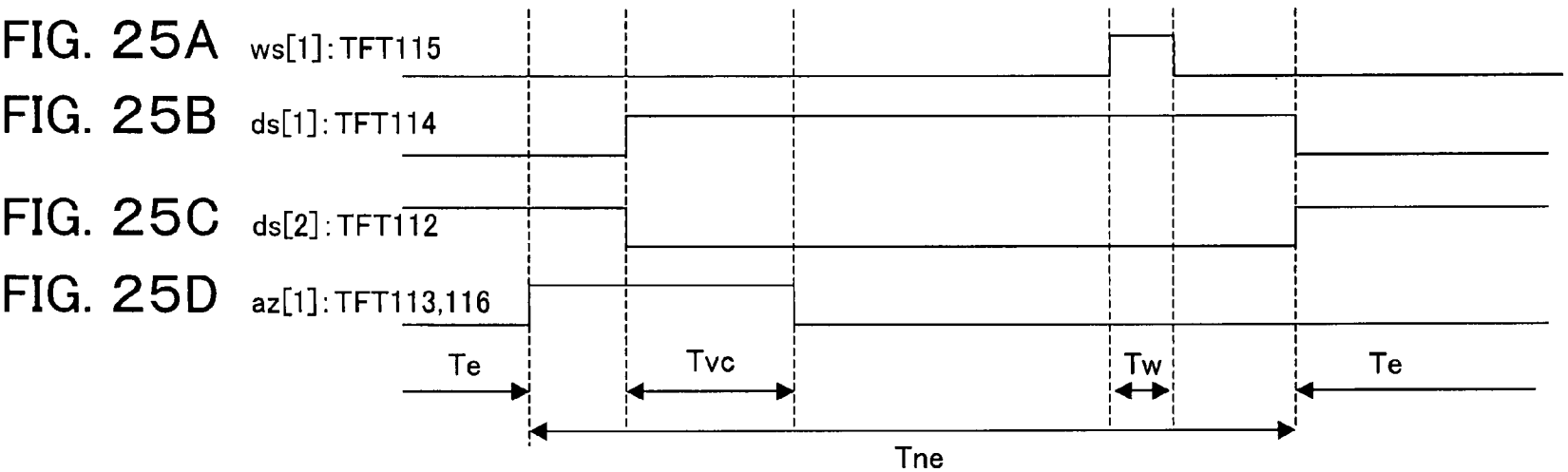
FIG. 25A ws[1]: TFT115
FIG. 25B ds[1]: TFT114
FIG. 25C ds[2]: TFT112
FIG. 25D az[1]: TFT113,116
Te
Tvc
Tne
Tw
Te FIG. 31A ws[1]: TFT115
FIG. 31B ds[1]: TFT112B,114
FIG. 31C az[1]: TFT113,116
Te
Tvc
Tne
Tw
Te

PIXEL CIRCUIT, DISPLAY DEVICE, AND METHOD FOR DRIVING PIXEL CIRCUIT

TECHNICAL FIELD

The present invention relates to a pixel circuit having an electro-optic element with a luminance controlled by a current value in an organic EL (electroluminescence) display etc., an image display device comprised of such pixel circuits arrayed in a matrix, in particular a so-called active matrix type image display device controlled in value of current flowing through the electro-optic elements by insulating gate type field effect transistors provided inside the pixel circuits, and a method of driving a pixel circuit.

BACKGROUND ART

In an image display device, for example, a liquid crystal display, a large number of pixels are arranged in a matrix and the light intensity is controlled for every pixel in accordance with the image information to be displayed so as to display an image.

This same is true for an organic EL display etc. An organic EL display is a so-called self-light emitting type display having a light emitting element in each pixel circuit and has the advantages that the viewability of the image is higher in comparison with a liquid crystal display, a backlight is unnecessary, the response speed is high, etc.

Further, it greatly differs from a liquid crystal display etc. in the point that the gradations of the color generation are obtained by controlling the luminance of each light emitting element by the value of the current flowing through it, that is, each light emitting element is a current controlled type.

An organic EL display, in the same way as a liquid crystal display, may be driven by a simple matrix and an active matrix system. While the former has a simple structure, it has the problem that realization of a large sized and high definition display is difficult. For this reason, much effort is being devoted to development of the active matrix system of controlling the current flowing through the light emitting element inside each pixel circuit by an active element provided inside the pixel circuit, generally, a TFT (thin film transistor).

FIG. 1 is a block diagram of the configuration of a general organic EL display device.

This display device 1 has, as shown in FIG. 1, a pixel array portion 2 comprised of pixel circuits (PXLC) 2*a* arranged in an m×n matrix, a horizontal selector (HSEL) 3, a write scanner (WSCN) 4, data lines DTL1 to DTLn selected by the horizontal selector 3 and supplied with a data signal in accordance with the luminance information, and scanning lines WSL1 to WSLm selectively driven by the write scanner 4.

Note that the horizontal selector 3 and the write scanner 4 are sometimes formed around the pixels by MOSICs etc. when formed on polycrystalline silicon.

FIG. 2 is a circuit diagram of an example of the configuration of a pixel circuit 2*a* of FIG. 1 (refer to for example U.S. Pat. No. 5,684,365 and Patent Publication 2: Japanese Unexamined Patent Publication (Kokai) No. 8-234683).

The pixel circuit of FIG. 2 has the simplest circuit configuration among the large number of proposed circuits and is a so-called two-transistor drive type circuit.

The pixel circuit 2*a* of FIG. 2 has a p-channel thin film FET (hereinafter, referred to as TFT) 11 and TFT 12, a capacitor C11, and a light emitting element 13 comprised of an organic EL element (OLED). Further, in FIG. 2, DTL indicates a data line, and WSL indicates a scanning line.

An organic EL element has a rectification property in many cases, so sometimes is referred to as an OLED (organic light emitting diode). The symbol of a diode is used as the light emitting element in FIG. 2 and the other figures, but a rectification property is not always required for an OLED in the following explanation.

In FIG. 2, a source of the TFT 11 is connected to a power source potential VCC, and a cathode of the light emitting element 13 is connected to a ground potential GND. The operation of the pixel circuit 2*a* of FIG. 2 is as follows.

<Step ST1>:

When the scanning line WSL is made a selected state (low level here) and a write potential Vdata is supplied to the data line DTL, the TFT 12 becomes conductive, the capacitor C11 is charged or discharged, and the gate potential of the TFT 11 becomes Vdata.

<Step ST2>:

When the scanning line WSL is made a non-selected state (high level here), the data line DTL and the TFT 11 are electrically separated, but the gate potential of the TFT 11 is held stably by the capacitor C11.

<Step ST3>:

The current flowing through the TFT 11 and the light emitting element 13 becomes a value in accordance with a gate-source voltage Vgs of the TFT 11, while the light emitting element 13 is continuously emitting light with a luminance in accordance with the current value.

As in the above step ST1, the operation of selecting the scanning line WSL and transmitting the luminance information given to the data line to the inside of a pixel will be referred to as "writing" below.

As explained above, in the pixel circuit 2*a* of FIG. 2, if once the Vdata is written, the light emitting element 13 continues to emit light with a constant luminance in the period up to the next rewrite operation.

As explained above, in the pixel circuit 2*a*, by changing a gate application voltage of the drive transistor constituted by the TFT 11, the value of the current flowing through the EL light emitting element 13 is controlled.

At this time, the source of the p-channel drive transistor is connected to the power source potential Vcc, so this TFT 11 is always operating in a saturated region. Accordingly, it becomes a constant current source having a value shown in the following equation 1.

$$Ids = \tfrac{1}{2} \cdot \mu (W/L) Cox (Vgs - |Vth|)^2 \quad (1)$$

Here, p indicates the mobility of a carrier, Cox indicates a gate capacitance per unit area, W indicates a gate width, L indicates a gate length, Vgs indicates the gate-source voltage of the TFT 11, and Vth indicates the threshold value of the TFT 11.

In a simple matrix type image display device, each light emitting element emits light only at a selected instant, while in an active matrix, as explained above, each light emitting element continues emitting light even after the end of the write operation. Therefore, it becomes advantageous in especially a large sized and high definition display in the point that the peak luminance and peak current of each light emitting element can be lowered in comparison with a simple matrix.

FIG. 3 is a view of the change along with elapse of the current-voltage (I-V) characteristic of an organic EL element. In FIG. 3, the curve shown by the solid line indicates the characteristic in the initial state, while the curve shown by the broken line indicates the characteristic after change along with elapse.

In general, the I-V characteristic of an organic EL element ends up deteriorating along with elapse as shown in FIG. 3.

However, since the two-transistor drive system of FIG. 2 is a constant current drive system, a constant current is continuously supplied to the organic EL element as explained above. Even if the I-V characteristic of the organic EL element deteriorates, the luminance of the emitted light will not change along with elapse.

The pixel circuit 2*a* of FIG. 2 is comprised of p-channel TFTs, but if it were possible to configure it by n-channel TFTs, it would be possible to use an amorphous silicon (a-Si) process in the past in the fabrication of the TFTs. This would enable a reduction in the cost of TFT boards.

Next, consider a pixel circuit replacing the transistors with n-channel TFTs.

FIG. 4 is a circuit diagram of a pixel circuit replacing the p-channel TFTs of the circuit of FIG. 2 with n-channel TFTs.

The pixel circuit 2*b* of FIG. 4 has an n-channel TFT 21 and TFT 22, a capacitor C21, and a light emitting element 23 comprised of an organic EL element (OLED). Further, in FIG. 4, DTL indicates a data line, and WSL indicates a scanning line.

In the pixel circuit 2*b*, the drain side of the drive transistor constituted by the TFT 21 is connected to the power source potential Vcc, and the source is connected to the anode of the EL element 23, whereby a source-follower circuit is formed.

FIG. 5 is a view of the operating point of a drive transistor constituted by the TFT 21 and an EL element 23 in the initial state. In FIG. 5, the abscissa indicates the drain-source voltage Vds of the TFT 21, while the ordinate indicates the drain-source current Ids.

As shown in FIG. 5, the source voltage is determined by the operating point of the drive transistor constituted by the TFT 21 and the EL light emitting element 23. The voltage differs in value depending on the gate voltage.

This TFT 21 is driven in the saturated region, so a current Ids of the value of the above equation 1 is supplied for the Vgs for the source voltage of the operating point.

However, here too, similarly, the I-V characteristic of the EL element ends up deteriorating along with elapse. As shown in FIG. 6, the operating point ends up fluctuating due to this change along with elapse. The source voltage fluctuates even if supplying the same gate voltage.

Due to this, the gate-source voltage Vgs of the drive transistor constituted by the TFT 21 ends up changing and the value of the current flowing fluctuates. The value of the current flowing through the EL light emitting element 23 simultaneously changes, so if the I-V characteristic of the EL light emitting element 23 deteriorates, the luminance of the emitted light will end up changing along with elapse in the source-follower circuit of FIG. 4.

Further, as shown in FIG. 7, a circuit configuration where the source of the drive transistor constituted by the n-channel TFT 31 is connected to the ground potential GND, the drain is connected to the cathode of the EL element 33, and-the anode of the EL light emitting element 33 is connected to the power source potential Vcc may be considered.

With this system, in the same way as when driven by the p-channel TFT of FIG. 2, the potential of the source is fixed, the drive transistor constituted by the TFT 31 operates as a constant current source, and a change in the luminance due to deterioration of the I-V characteristic of the EL light emitting element 33 can be prevented.

With this system, however, the drive transistor has to be connected to the cathode side of the EL light emitting element. This cathodic connection requires development of new anode-cathode electrodes. This is considered extremely difficult with the current level of technology.

From the above, in the past systems, no organic EL element using a n-channel transistor free of change in luminance has been developed.

DISCLOSURE OF THE INVENTION

An object of the present invention is to provide a pixel circuit, display device, and method of driving a pixel circuit enabling source-follower output with no deterioration of luminance even with a change of the current-voltage characteristic of the light emitting element along with elapse, enabling a source-follower circuit of n-channel transistors, and able to use an n-channel transistor as a drive element of an electro-optic element while using current anode-cathode electrodes.

To achieve the above object, according to a first aspect of the present invention, there is provided a pixel circuit for driving an electro-optic element with a luminance changing according to a flowing current, comprising a data line through which a data signal in accordance with luminance information is supplied; first, second, third, and fourth nodes; first and second reference potentials; a pixel capacitance element connected between the first node and the second node; a coupling capacitance element connected between the second node and the fourth node; a drive transistor forming a current supply line between the first terminal and the second terminal and controlling a current flowing through the current supply line in accordance with the potential of a control terminal connected to the second node; a first switch connected to the third node; a second switch connected between the second node and the third node; a third switch connected between the first node and a fixed potential; a fourth switch connected between the data line and the fourth node; and a fifth switch connected between the fourth node and a predetermined potential; the first switch, the third node, the current supply line of the drive transistor, the first node, and the electro-optic element being connected in series between the first reference potential and second reference potential.

Preferably, the drive transistor is a field effect transistor with a source connected to the first node and a drain connected to the third node.

Preferably, when the electro-optic element is driven, as a first stage, the first switch is held in a conductive state, the fourth switch is held in a non-conductive state, and, in that state, the third switch is held at a conductive state and the first node is connected to a fixed potential; as a second stage, the second switch and the fifth switch are held in a conductive state, the first switch is held in a non-conductive state, then the second switch and the fifth switch are held in a non-conductive state; as a third stage, the fourth switch is held in a conductive state, data to be propagated through the data line is input to the fourth node, then the fourth switch is held in a non-conductive state; and as a fourth stage, the third switch is held in a non-conductive state.

Preferably, when the electro-optic element is driven, as a first stage, the first switch and fourth switch are held in a non-conductive state and, in that state, the third switch is held in a conductive state and the first node is connected to a fixed potential; as a second stage, the second switch and the fifth switch are held in a conductive state, the first switch is held in a conductive state for a predetermined period, then the second switch and the fifth switch are held in a non-conductive state; as a third stage, the fourth switch is held in a conductive state, data to be propagated through the data line is input to the fourth node, then the fourth switch is held in a non-conductive state; and as a fourth stage, the third switch is held in a non-conductive state.

Preferably, at the third stage, the first switch is held at a conductive state, then the fourth switch is held at a conductive state.

Preferably, when the electro-optic element is driven, as a first stage, the first switch is held in a conductive state, the fourth switch is held in a non-conductive state, and, in that state, the second switch and the fifth switch are held in a conductive state; as a second stage, the first switch is held in a non-conductive state, while the third switch is held in a conductive state and the first node is connected to a fixed potential; as a third stage, the second switch and the fifth switch are held in a non-conductive state; as a fourth stage, the fourth switch is held in a conductive state, data to be propagated through the data line is input to the fourth node, then the fourth switch is held in a non-conductive state; and as a fifth stage, the first switch is held in a conductive state, while the third switch is held in a non-conductive state.

According to a second aspect of the present invention, there is provided a display device comprising a plurality of pixel circuits arranged in a matrix; a data line arranged for each column of the matrix array of pixel circuits and through which a data signal in accordance with luminance information is supplied; and first and second reference potentials; each the pixel circuit further having an electro-optic element with a luminance changing according to a flowing current, first, second, third, and fourth nodes, a pixel capacitance element connected between the first node and the second node; a coupling capacitance element connected between the second node and the fourth node; a drive transistor forming a current supply line between the first terminal and the second terminal and controlling a current flowing through the current supply line in accordance with the potential of a control terminal connected to the second node; a first switch connected to the third node; a second switch connected between the second node and the third node; a third switch connected between the first node and a fixed potential; a fourth switch connected between the data line and the fourth node; and a fifth switch connected between the fourth node and a predetermined potential; the first switch, the third-node, the current supply line of the drive transistor, the first node, and the electro-optic element being connected in series between the first reference potential and second reference potential.

Preferably, the device further includes a drive device for complementarily holding the first switch at a non-conductive state while holding the third switch at a conductive state in a non-emitting period of the electro-optic element.

According to a third aspect of the present invention, there is provided a method of driving a pixel circuit having an electro-optic element with a luminance changing according to a flowing current, a data line through which a data signal in accordance with luminance information is supplied; first, second, third, and fourth nodes; first and second reference potentials; a pixel capacitance element connected between the first node and the second node; a coupling capacitance element connected between the second node and the fourth node; a drive transistor forming a current supply line between the first terminal and the second terminal and controlling a current flowing through the current supply line in accordance with the potential of a control terminal connected to the second node; a first switch connected to the third node; a second switch connected between the second node and the third node; a third switch connected between the first node and a fixed potential; a fourth switch connected between the data line and the fourth node; and a fifth switch connected between the fourth node and a predetermined potential; the first switch, the third node, the current supply line of the drive transistor, the first node, and the electro-optic element being connected in series between the first reference potential and second reference potential, the method of driving a pixel circuit comprising steps of holding the first switch in a conductive state, holding the fourth switch in a non-conductive state, and, in that state, holding the third switch at a conductive state and connecting the first node to a fixed potential; holding the second switch and the fifth switch in a conductive state, holding the first switch in a non-conductive state, then holding the second switch and the fifth switch in a non-conductive state; holding the fourth switch in a conductive state, inputting data to be propagated through the data line to the fourth node, then holding the fourth switch in a non-conductive state; and holding the third switch in a non-conductive state and electrically separate the first node from the fixed potential.

According to a fourth aspect of the invention, there is provided a method of driving a pixel circuit having an electro-optic element with a luminance changing according to a flowing current, a data line through which a data signal in accordance with luminance information is supplied; first, second, third, and fourth nodes; first and second reference potentials; a pixel capacitance element connected between the first node and the second node; a coupling capacitance element connected between the second node and the fourth node; a drive transistor forming a current supply line between the first terminal and the second terminal and controlling a current flowing through the current supply line in accordance with the potential of a control terminal connected to the second node; a first switch connected to the third node; a second switch connected between the second node and the third node; a third switch connected between the first node and a fixed potential; a fourth switch connected between the data line and the fourth node; and a fifth switch connected between the fourth node and a predetermined potential; the first switch, the third node, the current supply line of the drive transistor, the first node, and the electro-optic element being connected in series between the first reference potential and second reference potential, the method of driving a pixel circuit comprising steps of holding the first switch and fourth switch in a non-conductive state and, in that state, holding the third switch in a conductive state and connecting the first node to a fixed potential; holding the second switch and the fifth switch in a conductive state, holding the first switch in a conductive state for a predetermined period, then holding the second switch and the fifth switch in a non-conductive state; holding the fourth switch in a conductive state, inputting data to be propagated through the data line to the fourth node, then holding the fourth switch in a non-conductive state; and holding the third switch is held in a non-conductive state and electrically separating the first node to the fixed potential.

According to a fifth aspect of the present invention, there is provided a method of driving a pixel circuit having an electro-optic element with a luminance changing according to a flowing current, a data line through which a data signal in accordance with luminance information is supplied; first, second, third, and fourth nodes; first and second reference potentials; a pixel capacitance element connected between the first node and the second node; a coupling capacitance element connected between the second node and the fourth node; a drive transistor forming a current supply line between the first terminal and the second terminal and controlling a current flowing through the current supply line in accordance with the potential of a control terminal connected to the second node; a first switch connected to the third node; a second switch connected between the second node and the third node; a third switch connected between the first node and a fixed potential; a fourth switch connected between the data line and the fourth node; and a fifth switch connected between the fourth node and a predetermined potential; the first switch, the third node, the current supply line of the drive transistor, the first node, and the electro-optic element being connected in series between the first reference potential and second reference potential, the method of driving a pixel circuit comprising steps of holding the first switch in a conductive state, holding the fourth switch is held in a non-conductive state, and, in that state, holding the second switch and the fifth switch in a conductive state; holding the first switch in a non-conductive state, while holding the third switch in a conductive state and connecting the first node to a fixed potential; holding the second switch and the fifth switch in a non-conductive state; holding the fourth switch in a conductive state, inputting data to be propagated through the data line to the fourth node, then holding the fourth switch in a non-conductive state; and holding the first switch in a conductive state, while holding the third switch in a non-conductive state and electrically separating said first node to said fixed potential.

According to the present invention, for example at the time of the emitting period of the electro-optic element, the first switch is held at the on state (conductive state) and the second to fifth switches are held in the off state (non-conductive state).

The drive transistor is designed to operate in the saturated region. The current Ids flowing to the electro-optic element takes the value shown by the above equation 1.

The first switch is held in the on state, the second switch, fourth switch, and fifth switch are held in the off state, and the third switch is turned on.

At this time, current flows through the third switch, and the source potential of the drive transistor falls to for example the ground potential GND. Therefore, the voltage applied to the electro-optic element becomes 0V, and the electro-optic element does not emit light.

In this case, even if the third switch turns on, the voltage held at the pixel capacitance element, that is, the gate voltage of the drive transistor, does not change, so the current Ids flows by the route of the first switch, third node, drive transistor, first node, and third switch.

Next, in the non-emitting period of the electro-optic element, the third switch is held in the on state, the fourth switch is held in the off state, the second switch and fifth switch are turned on, and the first switch is turned off.

At this time, the gate and drain of the drive transistor are connected through the second switch, so the drive transistor operates in the saturated region. Further, the gate of the drive transistor has the pixel capacitance element and coupling capacitance element connected to it in parallel, so the gate-drain voltage Vgd gradually is reduced along with time. Further, after the elapse of a predetermined time, the gate-source voltage Vgs of the drive transistor becomes the threshold voltage Vth of the drive transistor.

At this time, the coupling capacitance element is charged with (Vofs−Vth) and the pixel capacitance element is charged with Vth when the predetermined potential is Vofs.

Next, the third is held in the on state, the fourth switch is held in the off state, the second and fifth switches are turned off, and the first switch is turned on. Due to this, the drain voltage of the drive transistor becomes the first reference potential, for example, the power source voltage.

Next, the third and first switches are held in the on state, the second and fifth switches are held in the off state, and the fourth switch is turned on.

Due to this, the input voltage Vin propagated through the data line is input through the fourth switch, while the voltage change amount ΔV of the fourth node is coupled with the gate of the drive transistor.

At this time, the gate voltage Vg of the drive transistor is a value of Vth, while the coupling amount ΔV is determined by the capacity C1 of the pixel capacitance element, the capacity C2 of the coupling capacitance element, and the parasitic capacity C3 of the drive transistor.

Therefore, if making C1 and C2 sufficiently larger than C3, the amount of coupling to the gate is determined by only the capacity C1 of the pixel capacitance element and the capacity C2 of the coupling capacitance element.

The drive transistor is designed to operate in the saturated region, so a current Ids in accordance with the amount of voltage coupled with the gate of the drive transistor flows.

After the writing ends, the first switch is held in the on state, the second and fifth switches are held in the off state, the fourth switch is turned off, and the third switch is turned off.

In this case, even if the third switch turns off, the gate-source voltage of the drive transistor is constant, so the drive transistor runs a constant current Ids to the electro-optic element. Due to this, the potential of the first node is boosted to the voltage Vx at which the current Ids runs to the electro-optic element, and the electro-optic element emits light.

Here, in this circuit as well, the electro-optic element ends up changing in current-voltage (I-V) characteristic when the emitting period becomes longer. Therefore, the potential of the first node also changes. However, the gate-source voltage Vgs of the drive transistor is held at a constant value, so the current flowing to the electro-optic element does not change. Accordingly, even if the I-V characteristic of the electro-optic element deteriorates, the constant current Ids continues to flow and the luminance of the electro-optic element does not change.

BRIEF DESCRIPTION OF THE DRAWINGS

FIGS. 10A to 10D are timing charts for explaining a first method of driving the circuit of FIG. 9.

FIG. 17A to FIG. 17D are timing charts for explaining a third method of driving the pixel circuit of FIG. 9.

FIG. 22A to FIG. 22D are timing charts for explaining a fourth method of driving the pixel circuit of FIG. 9.

FIGS. 25A to 25D are timing charts for explaining a method of driving the circuit of FIG. 24.

BEST MODE FOR WORKING THE INVENTION

Below, preferred embodiments of the present invention will be described with reference to the accompanying drawings.

First Embodiment

Figure 1:
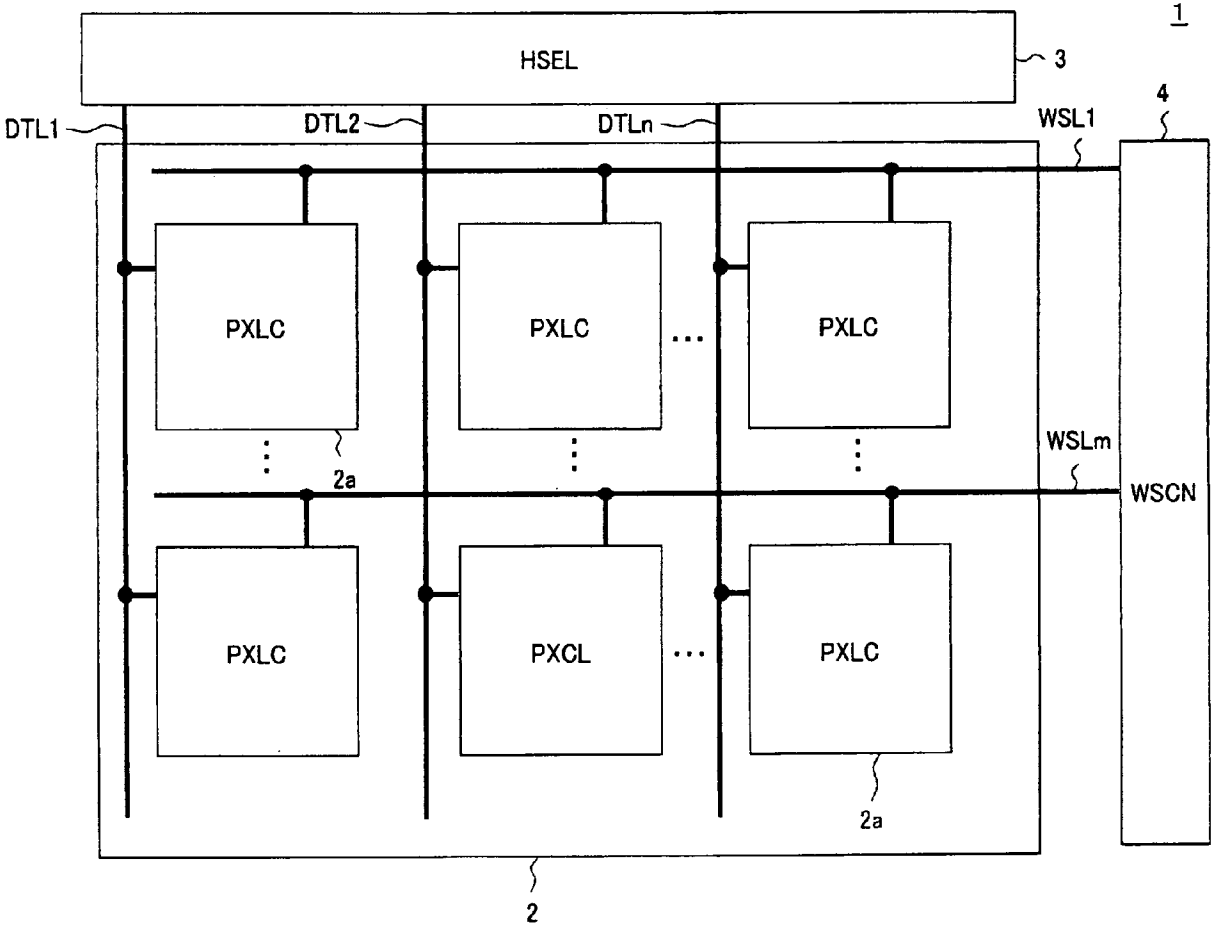
FIG. 1 Prior Art
FIG. 1 is a block diagram of the configuration of a general organic EL display device.
Figure 2:
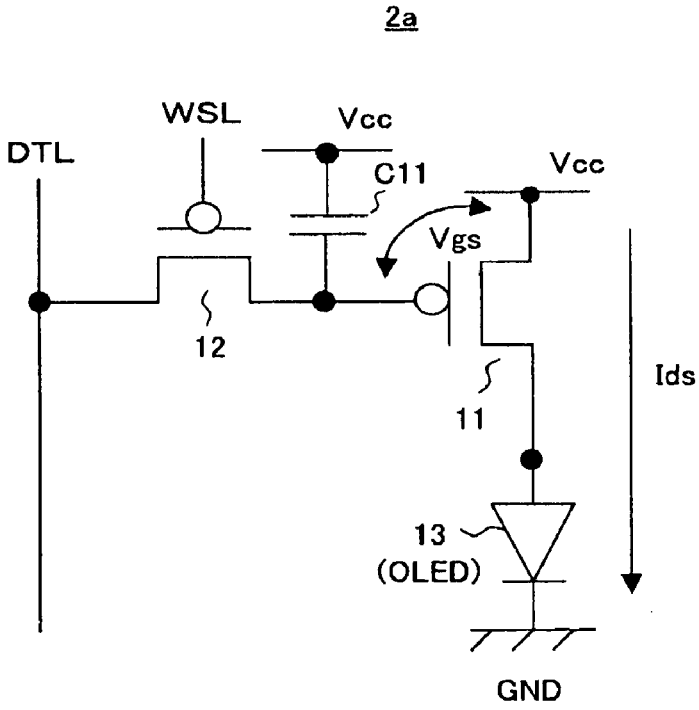
FIG. 2 Prior Art
FIG. 2 is a circuit diagram of an example of the configuration of a pixel circuit of FIG. 1.
Figure 3:
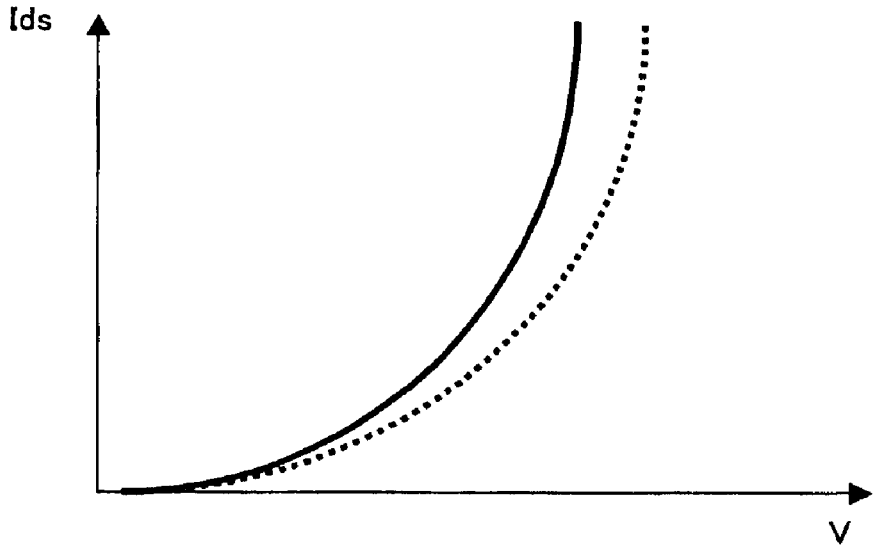
FIG. 3 Prior Art
FIG. 3 is a graph of the change along with elapse of the current-voltage (I-V) characteristic of an organic EL device.
Figure 4:
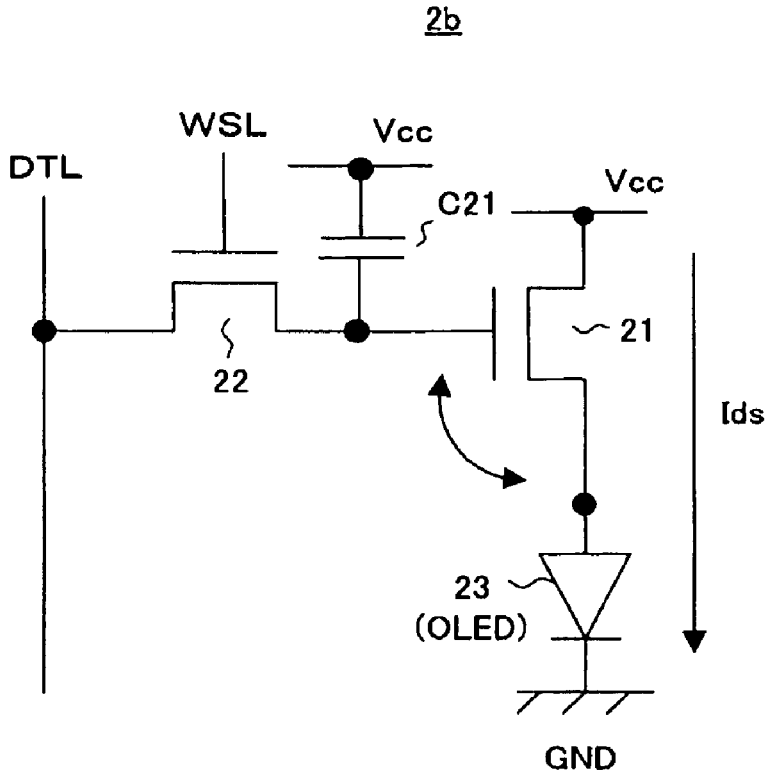
FIG. 4 Prior Art
FIG. 4 is a circuit diagram of a pixel circuit in which p-channel TFTs of the circuit of FIG. 2 are replaced by n-channel TFTs.
Figure 5:
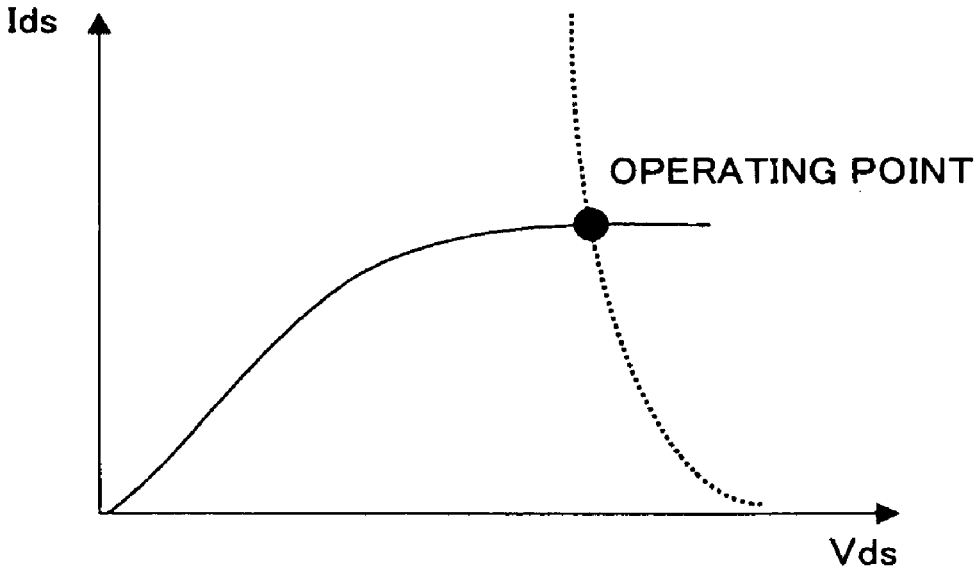
FIG. 5 Prior Art
FIG. 5 is a graph showing the operating point of a drive transistor constituted by a TFT and an EL device in the initial state.
Figure 6:
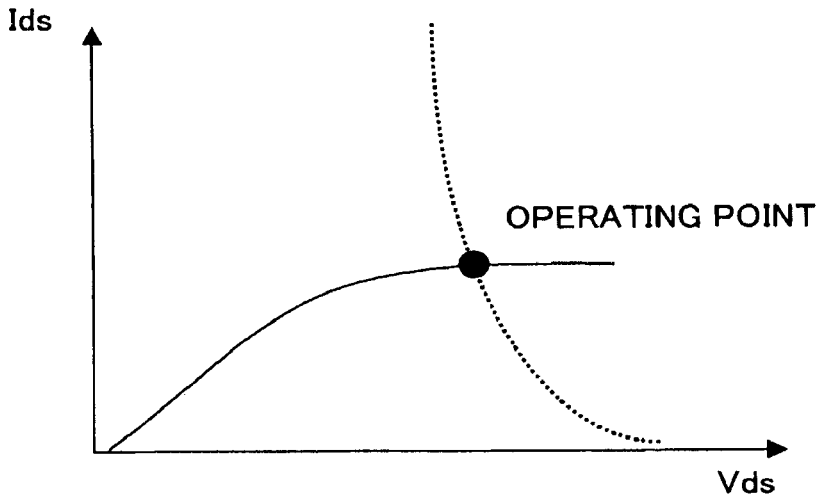
FIG. 6 Prior Art
FIG. 6 is a graph showing the operating point of a drive transistor constituted by a TFT and an EL device after change along with elapse.
Figure 7:
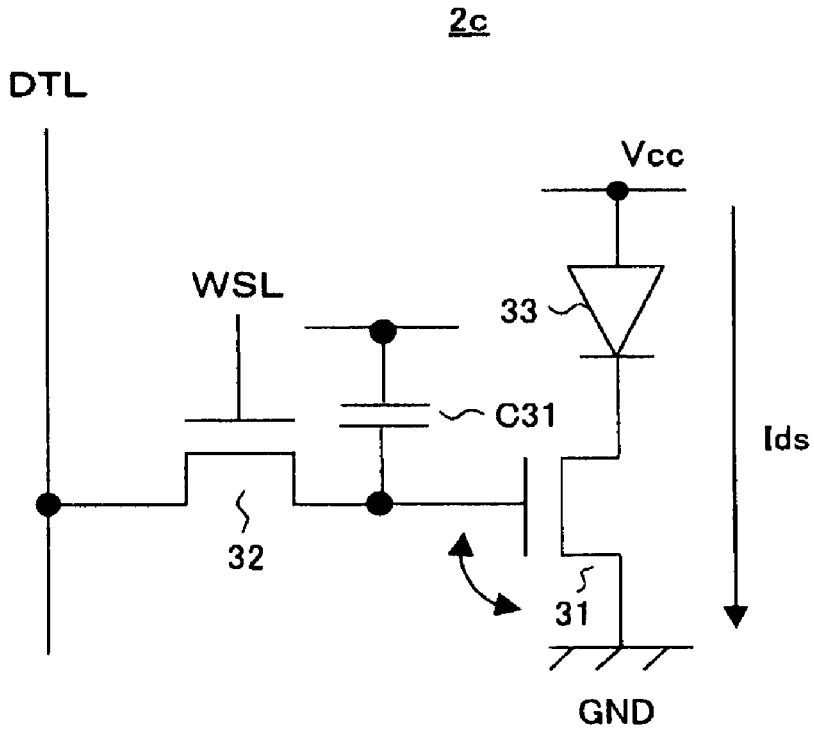
FIG. 7 Prior Art
FIG. 7 is a circuit diagram of a pixel circuit connecting a source of a drive transistor constituted by an n-channel TFT to a ground potential.
Figure 8:
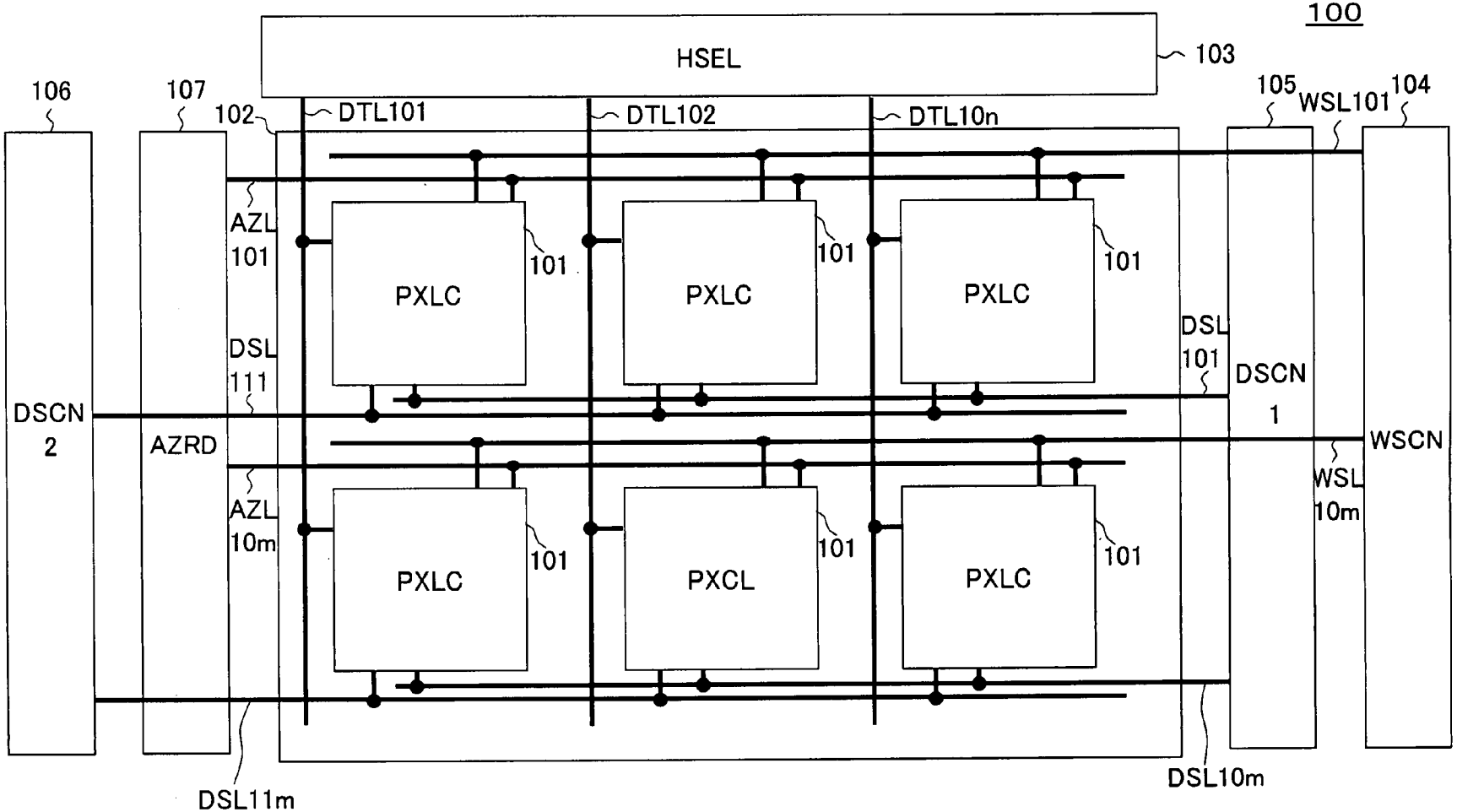
FIG. 8 is a block diagram of the configuration of an organic EL display device employing a pixel circuit according to a first embodiment.

FIG. 8 is a block diagram of the configuration of an organic EL display device employing pixel circuits according to the first embodiment.

Figure 9:
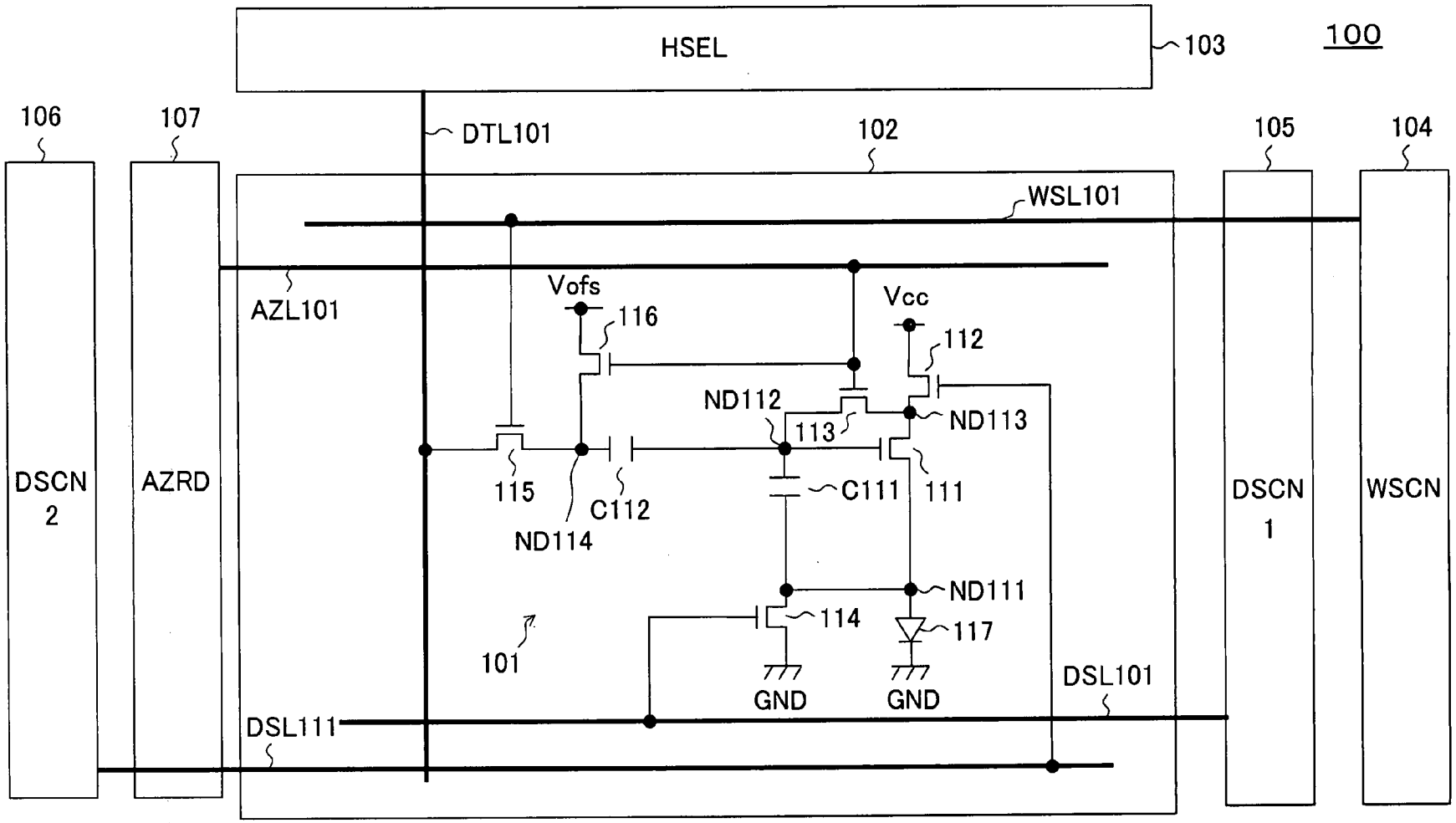
FIG. 9 is a circuit diagram of a specific configuration of a pixel circuit according to the first embodiment in the organic EL display device of FIG. 8.

FIG. 9 is a circuit diagram of the concrete configuration of a pixel circuit according to the first embodiment in the organic EL display device of FIG. 8.

This display device 100 has, as shown in FIG. 8 and FIG. 9, a pixel array portion 102 having pixel circuits (PXLC) 101 arranged in an m×n matrix, a horizontal selector (HSEL) 103, a write scanner (WSCN) 104, a first drive scanner (DSCN1) 105, a second drive scanner (DSCN2) 106, an auto zero circuit (AZRD) 107, data lines DTL101 to DTL10*n* selected by the horizontal selector 103 and supplied with a data signal in accordance with the luminance information, scanning lines WSL101 to WSL10*m* selectively driven by the write scanner 104, drive lines DSL101 to DSL10*m* selectively driven by the first drive scanner 105, drive lines DSL111 to DSL11*m* selectively driven by the second drive scanner 106, and auto zero lines AZL101 to AZL10*m* selectively driven by the auto zero circuit 107

Note that while the pixel circuits 101 are arranged in an m×n matrix In the pixel array portion 102, FIG. 8 shows an example wherein the pixel circuits are arranged In a 2 (=m)×3 (=n) matrix for the simplification of the drawing.

Further, in FIG. 9, the concrete configuration of one pixel circuit is shown for simplification of the drawing.

The pixel circuit 101 according to the first embodiment has, as shown in FIG. 9, an n-channel TFT 111 to TFT 116, capacitors C111 and C122, a light emitting element 117 made of an organic EL element (OLED), a first node ND111, second node ND112, third node ND113, and fourth node ND114.

Further, in FIG. 9, DTL101 indicates a data line, WSL101 indicates a scanning line, DSL101 and DSL111 indicate drive lines, and AZL101 indicates an auto zero line.

Among these components, the TFT 111 configures the field effect transistor according to the present invention (drive transistor), the TFT 112 configures the first switch, the TFT 113 configures the second switch, the TFT 114 configures the third switch, the TFT 115 configures the fourth switch, the TFT 116 configures the fifth switch, the capacitor C111 configures the pixel capacitance element according to the present invention, and the capacitor C112 configures the coupling capacitance element according to the present invention.

Further, the supply line (power source potential) of the power source voltage Vcc corresponds to the first reference potential, while the ground potential GND corresponds to the second reference potential.

In the pixel circuit 101, the TFT 112 as the first switch, the third node ND113, the TFT 111 as the drive transistor, the first node ND111, and the light emitting element (OLED) 117 are connected in series between the first reference potential (in the present embodiment, the power source potential VCC) and the second reference potential (in the present embodiment, the ground potential GND). Specifically, a cathode of the light emitting element 117 is connected to the ground potential GND, an anode is connected to the first node ND111, a source of the TFT 111 is connected to the first node ND111, a drain of the TFT 111 is connected to the third node ND113, and a source and a drain of the TFT 112 are connected between the third node ND113 and power source potential VCC.

Further, a gate of the TFT 111 is connected to the second node ND112, while a gate of the TFT 112 is connected to the drive line DSL111.

A source and a drain of the TFT 113 are connected between the second node ND112 and third node ND113, while a gate of the TFT 113 is connected to the auto zero line AZL101.

A drain of the TFT 114 is connected to the first node 111 and a first electrode of the capacitor C111, a source is connected to a fixed potential (in the present embodiment, the ground potential GND), and a gate of the TFT 114 is connected to the drive line DSL 101. Further, a second electrode of the capacitor C111 is connected to the second node ND112.

The first electrode of the capacitor C112 is connected to the second node ND112, while the second electrode is connected to the fourth node ND114.

A source and a drain of the TFT 115 as the fourth switch are connected to the data line DTL101 and fourth node ND114. Further, a gate of the TFT 115 is connected to the scanning line WSL101.

A source and a drain of the TFT 116 are connected to the fourth node ND114 and a predetermined potential Vofs. Further, a gate of the TFT 116 is connected to the auto zero line AZL101.

In this way, the pixel circuit 101 according to the present embodiment is configured with the capacitor C111 as a pixel capacitor connected between the gate and source of the TFT 111 as the drive transistor, with a source potential of the TFT 111 connected to a fixed potential through the TFT 114 as the switching transistor during a non-emitting period, and with the gate and source of the TFT 111 connected and the threshold value Vth corrected.

Next, the operation of the above configuration will be explained focusing on the operation of a pixel circuit with reference to FIGS. 10A to 10D and FIGS. 11A and 11B to FIGS. 14A and 14B.

Note that FIG. 10A shows a scanning signal ws[1] applied to the first row scanning line WSL101 of the pixel array, FIG. 10B shows a drive signal ds[1] applied to the first row drive line DSL101 of the pixel array, FIG. 10C shows a drive signal ds[2] applied to the first row drive line DSL111 of the pixel array, and FIG. 10D shows an auto zero signal az[1] applied to the first row auto zero line AZL101 of the pixel array.

Further, in FIG. 10A to FIG. 10D, the period shown by Te is the emitting period, the period shown by Tne is the non-emitting period, Tvc is the threshold value Vth cancel period, and the period shown by Tw is the write period.

First, at the time of the ordinary emitting state of the EL light emitting element 117, as shown in FIGS. 10A to 10D, the scanning signal ws[1] to the scanning line WSL101 is set to the low level by the write scanner 104, and the drive signal ds[1] to the drive line DSL101 is set to the low level by the drive scanner 105, the auto zero signal az[1] to the auto zero line AZL101 is set to the low level by the auto zero circuit 107, and the drive signal ds[2] to the drive line DSL111 is selectively set to the high level by the drive scanner 106.

Figure 11B:
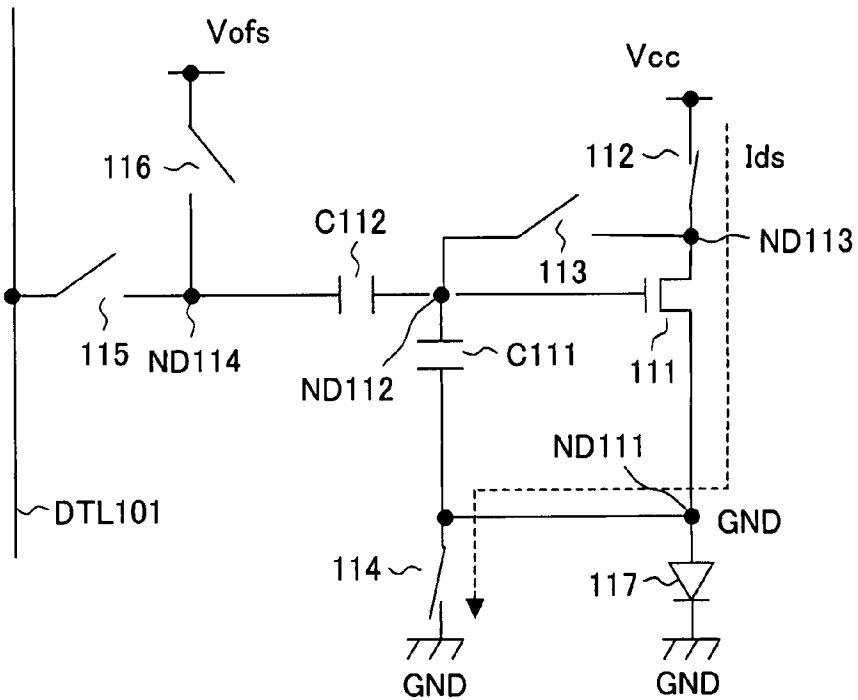
FIG. 11A and FIG. 11B are views for explaining the operation according to a first method of driving the circuit of FIG. 9.
Figure 11A:
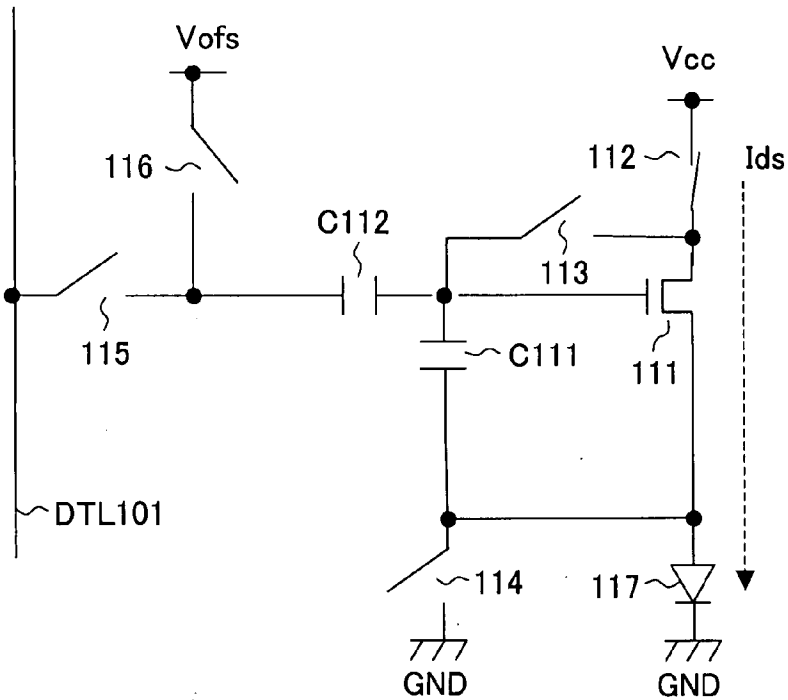

As a result, in each pixel circuit 101, as shown in FIG. 11A, the TFT 112 is held in the on state (conductive state) and the TFT 113 to TFT 116 are held in the off state (non-conductive-state).

The drive transistor 111 is designed to operate in the saturated region. The current Ids flowing to the EL light emitting element 117 takes the value shown by the above equation 1.

Next, in the non-emitting period Tne of the EL light emitting element 117, as shown in FIGS. 10A to 10D, the scanning signal ws[1] to the scanning line WSL101 is held at the low level by the write scanner 104, the auto zero signal az[1] to the auto zero line AZL101 is held at the low level by the auto zero circuit 107, the drive signal ds[2] to the drive line DSL111 is held at the high level by the drive scanner 106 and, in that state, the drive signal ds[1] to the drive line DSL101 is selectively set to the high level by the drive scanner 105.

As a result, in each pixel circuit 101, as shown in FIG. 11B, the TFT 112 is held in the on state, the TFT 113, TFT 115, and TFT 116 are held in the off state, and the TFT 114 is turned on.

At this time, current flows through the TFT 114, and the source potential Vs of the TFT 111 falls to the ground potential GND. Therefore, the voltage applied to the EL light emitting element 117 becomes 0V, and the EL light emitting element 117 does not emit light.

In this case, even if the TFT 114 turns on, the voltage held at the capacitor C111, that is, the gate voltage of the TFT 111, does not change, so the current Ids, as shown in FIG. 11B, flows by the route of the TFT 112, third node ND113, TFT 111, first node ND111, and TFT 114.

Next, in the non-emitting period Tne of the EL light emitting element 117, as shown in FIGS. 10A to 10D, the scanning signal ws[1] to the scanning line WSL101 is held at the low level by the write scanner 104, the drive signal ds[1] to the drive line DSL101 is held at the high level by the drive scanner 105 and, in that state, the auto zero signal az[1] to the auto zero line AZL101 is set to the high level by the auto zero circuit 107, then, as shown in FIG. 10C, the drive signal ds[2] to the drive line DSL111 is set to the low level by the drive scanner 106.

Figure 12B:
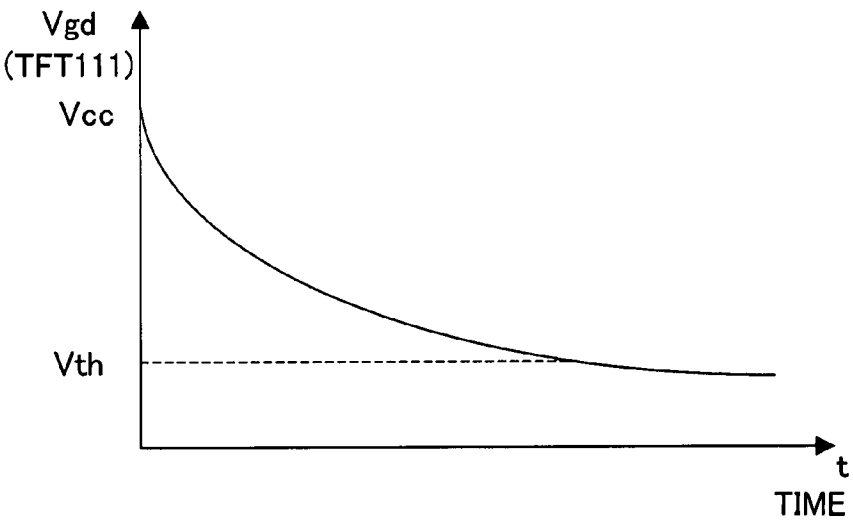
FIG. 12A and FIG. 12B are views for explaining the operation according to a first method of driving the circuit of FIG. 9.
Figure 12A:
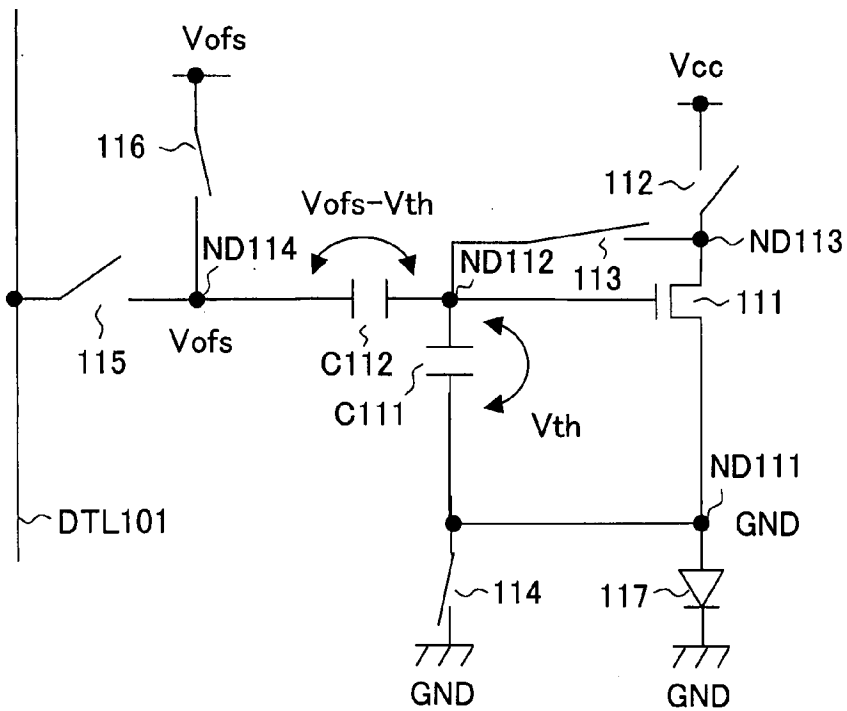

As a result, in each pixel circuit 101, as shown in FIG. 12A, the TFT 114 is held in the on state and the TFT 115 is held in the off state, the TFT 113 and TFT 116 are turned on, and the TFT 112 is turned off.

At this time, the gate and drain of the TFT 111 are connected through the TFT 113, so the TFT 111 operates in the saturated region. Further, the gate of the TFT 111 has the capacitors C111 and C112 connected to it in parallel, so the gate-drain voltage Vgd of the TFT 111, as shown in FIG. 12B, gradually is reduced along with time. Further, after the elapse of a predetermined time, the gate-source voltage Vgs of the TFT 111 becomes the threshold voltage Vth of the TFT 111.

At this time, the capacitor C112 is charged with (Vofs-Vth) and the capacitor C111 is charged with Vth.

Next, as shown in FIGS. 10A to 10D, the scanning signal ws[1] to the scanning line WSL101 is held at the low level by the write scanner 104, the drive signal ds[1] to the drive line DSL101 is held at the high level by the drive scanner 105, the drive signal ds[2] to the drive line DSL111 is set to the low level by the drive scanner 106 and, in that state, the auto zero signal az[1] to the auto zero line AZL101 is set to the low level by the auto zero circuit 107, then, as shown in FIG. 10C, the drive signal ds[2] to the drive line DSL111 is set to the high level by the drive scanner 106.

Figure 13B:
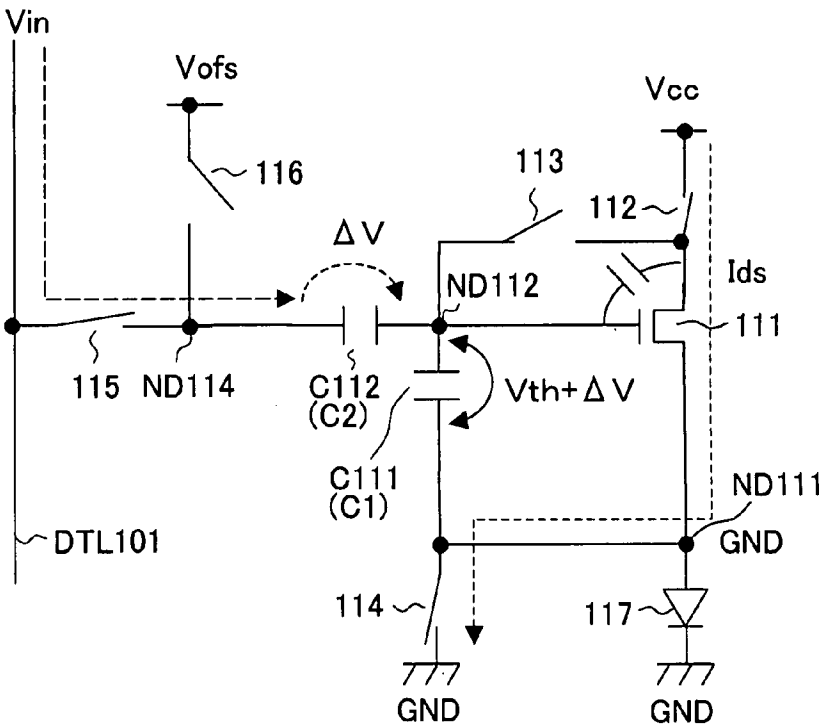
FIG. 13A and FIG. 13B are views for explaining the operation according to a first method of driving the circuit of FIG. 9.
Figure 13A:
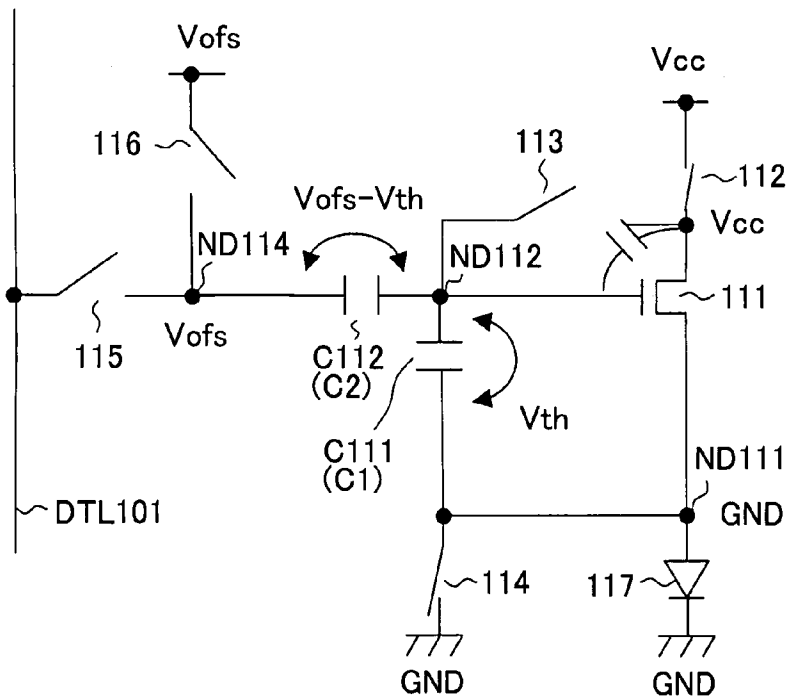

As a result, in each pixel circuit 101, as shown in FIG. 13A, the TFT 114 is held in the on state and the TFT 115 is held in the off state, the TFT 113 and TFT 116 are turned off, and the TFT 112 is turned on. Due to this, the drain voltage of the TFT 111 becomes the power source voltage VCC.

Next, as shown in FIGS. 10A to 10D, the drive signal ds[1] to the drive line DSL101 is held at the high level by the drive scanner 105, the drive signal ds[2] to the drive line DSL111 is held at the high level by the drive scanner 106, the auto zero signal az[1] to the auto zero line AZL101 is held at the low level by the auto zero circuit 107, and, in that state, the scanning signal ws[1] to the scanning line WSL101 is set to the high level by the write scanner 104.

As a result, in each pixel circuit 101, as shown in FIG. 13B, the TFT 114 and the TFT 112 are held in the on state and the TFT 113 and TFT 116 are held in the off state, and the TFT 115 is turned on.

Due to this, the input voltage Vin propagated through the data line DTL101 is input through the TFT 115, while the voltage change ΔV of the node ND114 is coupled with the gate of the TFT 111.

At this time, the gate voltage Vg of the TFT 111 is a value of Vth, while the coupling amount ΔV is determined as in the following equation 2 by the capacity C1 of the capacitor C111, the capacity C2 of the capacitor C112, and the parasitic capacity C3 of the TFT 111:

$$\Delta V=\{C2/(C1+C2+C3)\}(V\text{in}-V\text{ofs}) \quad (2)$$

Therefore, if making C1 and C2 sufficiently larger than C3, the amount of coupling to the gate is determined by only the capacity C1 of the capacitor C111 and the capacity C2 of the capacitor C112.

Figure 14B:
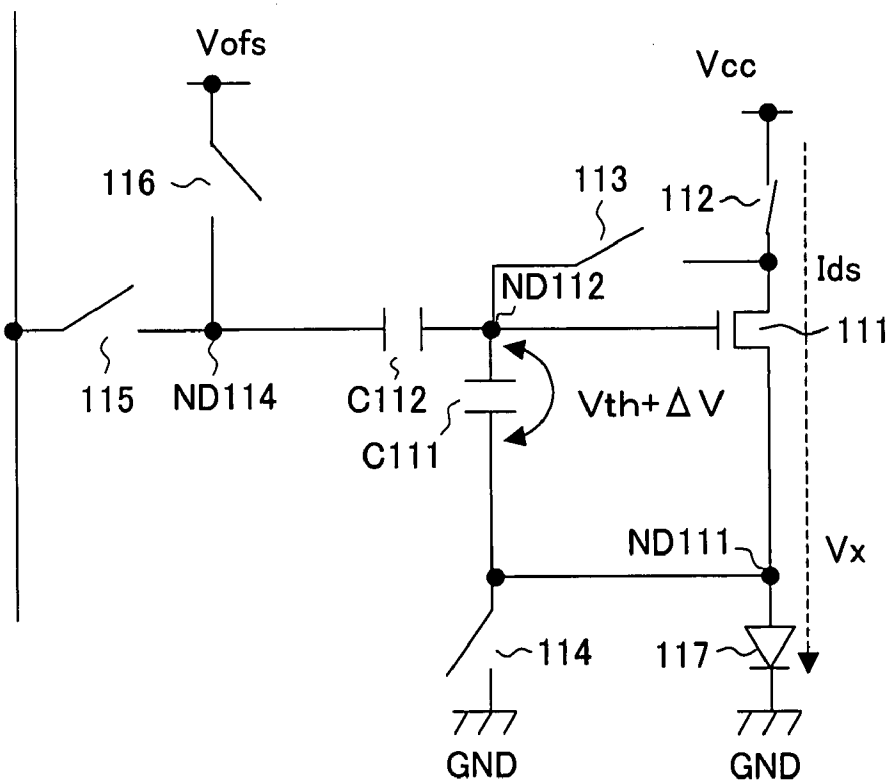
FIG. 14A and FIG. 14B are views for explaining the operation according to a first method of driving the circuit of FIG. 9.
Figure 14A:
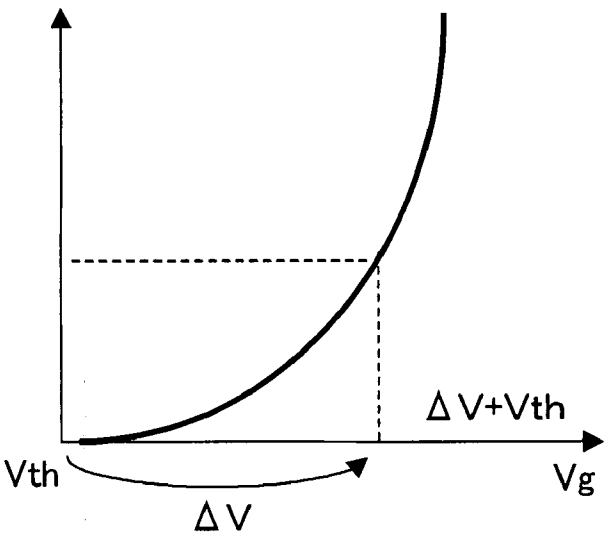
Figures 15A, 15B, 15C, 15D:
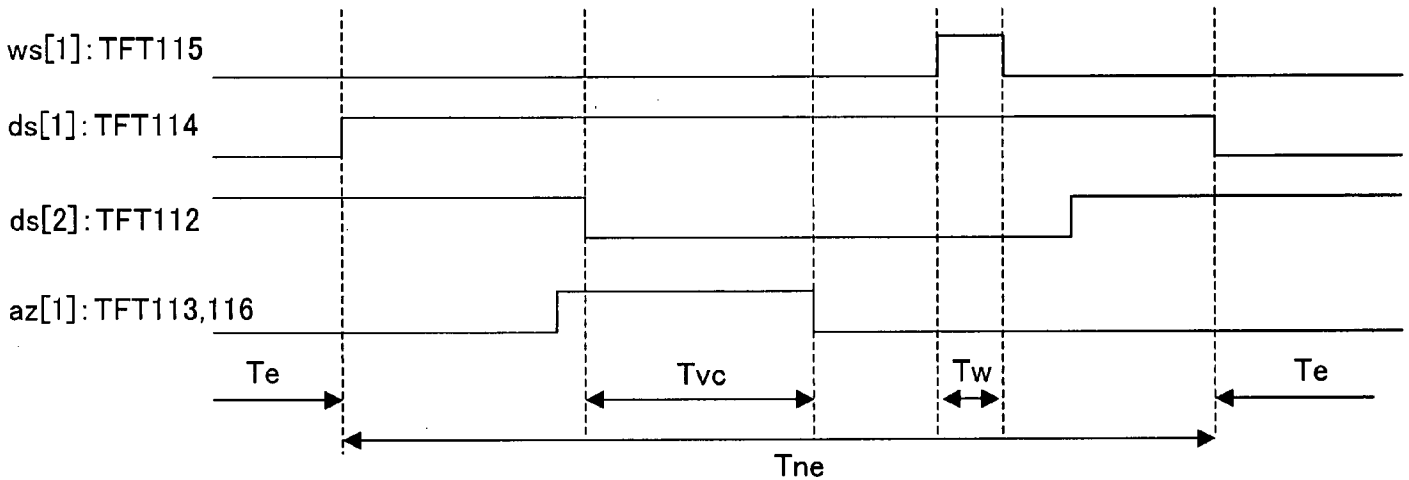
FIG. 15A to FIG. 15D are timing charts for explaining a second method of driving the pixel circuit of FIG. 9.

The TFT 111 is designed to operate in the saturated region, so as shown in FIG. 13B and FIG. 14A, a current Ids in accordance with the amount of voltage coupled with the gate of the TFT 111 flows.

After the writing ends, as shown in FIG. 10A to FIG. 10D, the drive signal ds[2] to the drive line DSL111 is held at the high level by the drive scanner 106, the auto zero signal az[1] to the auto zero line AZL101 is held at the low level by the auto zero circuit 107, and, in that state, the scanning signal ws[1] to the scanning line WSL101 is set to the low level by the write scanner 104, then the drive signal ds[1] to the drive line DSL101 is set to the low level by the drive scanner 105.

As a result, in each pixel circuit 101, as shown in FIG. 14B, the TFT 112 is held in the on state, the TFT 113 and TFT 116 are held in the off state, the TFT 115 is turned off, and the TFT 114 is turned off.

In this case, even if the TFT 114 turns off, the gate-source voltage of the TFT 111 is constant, so the TFT 111 runs a constant current Ids to the EL light emitting element 117. Due to this, the potential of the first node ND111 is boosted to the voltage Vx at which the current Ids runs to the EL light emitting element 117, and the EL light emitting element 117 emits light.

Here, in this circuit as well, the EL light emitting element ends up changing in current-voltage (I-V) characteristic when the emitting period becomes-longer. Therefore, the potential of the first node ND111 also changes. However, the gate-source voltage Vgs of the TFT 111 is held at a constant value, so the current flowing to the EL light emitting element 117 does not change. Accordingly, even if the I-V characteristic of the EL light emitting element 117 deteriorates, the constant current Ids continues to flow and the luminance of the EL light emitting element 117 does not change.

The above was the first method of driving the pixel circuit of FIG. 9. Next, the second method of driving will be explained with reference to FIG. 15A to FIG. 15D and FIGS. 16A and 16B.

The second method of driving differs from the above first method of driving in the timing of turning on the TFT 112 as the first switch in the non-emitting period Tne.

In the second method of driving, as shown in FIG. 15A to FIG. 15D, the timing for turning on the TFT 112 is set to after turning off the TFT 115.

Figure 16B:
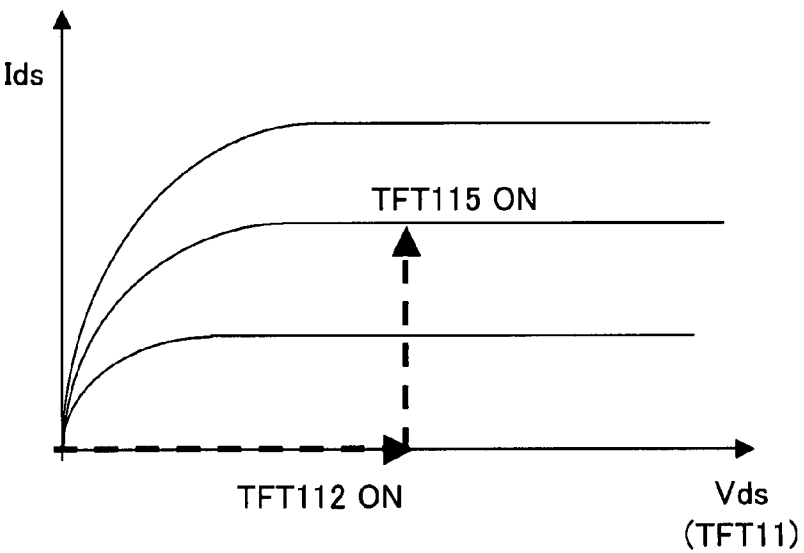
FIG. 16A and FIG. 16B are views for explaining by comparison the effects of a first method of driving and a second method of driving the pixel circuit of FIG. 9.
Figure 16A:
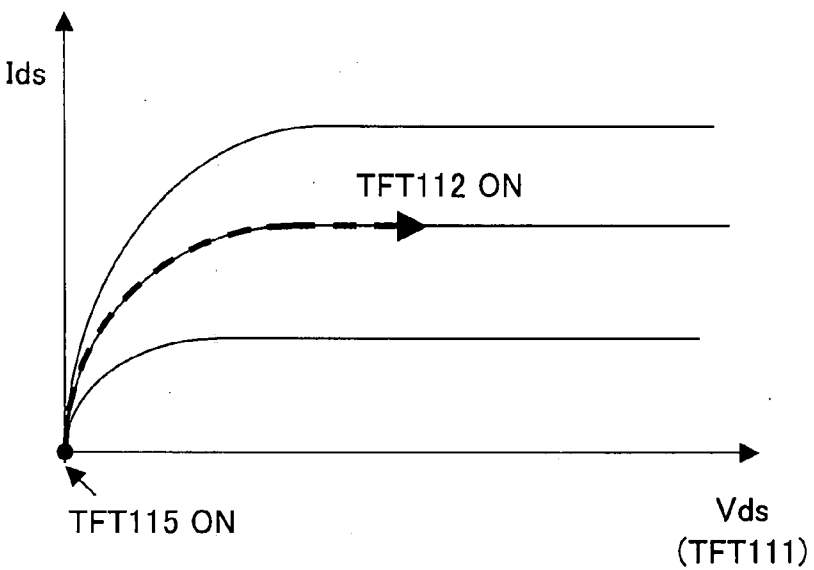

However, if turning off the TFT 115 then turning on the TFT 112, the TFT 111, as shown in FIG. 16A, operates from the linear region to the saturated region.

On the other hand, if turning on the TFT 112, then turning on the TFT 115 as with the first method of driving, the TFT 111 operates in only the saturated region as shown in FIG. 16B. The transistor has a shorter channel length in the saturated region than the linear region, so the parasitic capacity C3 is small.

Accordingly, turning the TFT 112 on, then turning the TFT 115 on as with the first method of driving enables the parasitic capacity C3 of the TFT 111 to be made smaller than when turning off the TFT 115, then turning on the TFT 112 like with the second method of driving.

If it is possible to make the parasitic capacity C3 small, when turning on the TFT 112, the amount of coupling from the drain to the gate of the TFT 111 can be made smaller and the capacity C1 of the capacitor C111 and the capacity C2 of the capacitor C112 can be made sufficiently larger than the parasitic capacity C3, so the change in the voltage of the fourth node ND114 when turning the TFT 115 on is coupled to the gate of the TFT 111 in accordance with the magnitudes of the C1 and C2.

Due to this, the first method of driving can be said to be better than the second method of driving.

Next, a third method of driving the pixel circuit of FIG. 9 will be explained with reference to FIG. 17A to FIG. 17D and FIGS. 18A and 18B to FIGS. 21A and 21B.

The third method of driving differs from the above first method of driving in the timing of turning on the TFT 112 as the first switch in the non-emitting period Tne. In the third method of driving, the TFT 112 functions as the duty switch. The operation will be explained below.

First, in the ordinary emitting period of the EL light emitting element 117, as shown in FIGS. 17A to 17D, the scanning signal ws[1] to the scanning line WSL101 is set to the low level by the write scanner 104, the drive signal ds[1] to the drive line DSL101 is set to the low level by the drive scanner 105, the auto zero signal az[1] to the auto zero line AZL101 is set to the low level by the auto zero circuit 107, and the drive signal ds[2] to the drive line DSL111 is selectively set to the high level by the drive scanner 106.

Figure 18B:
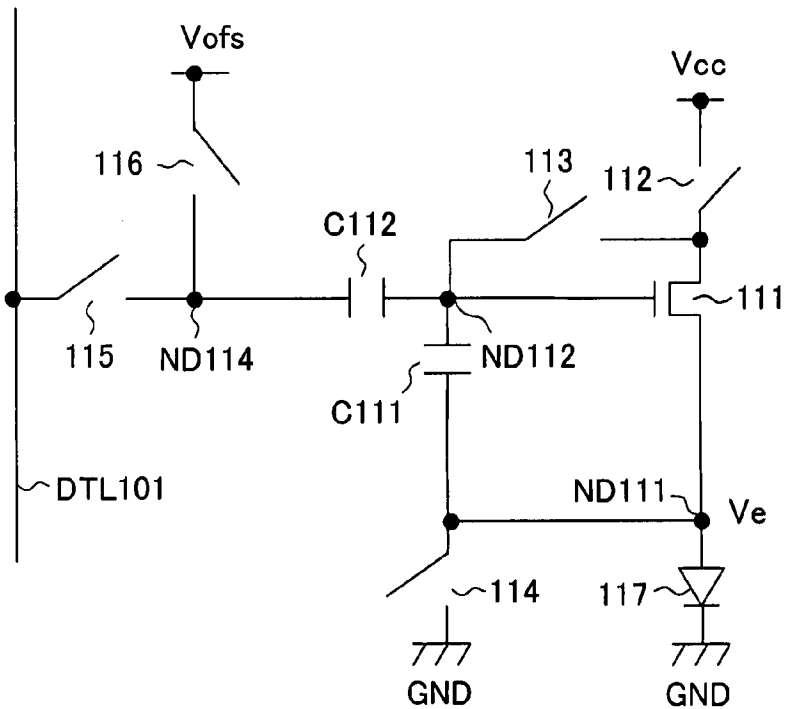
FIG. 18A and FIG. 18B are views for explaining the operation according to a third method of driving the circuit of FIG. 9.
Figure 18A:
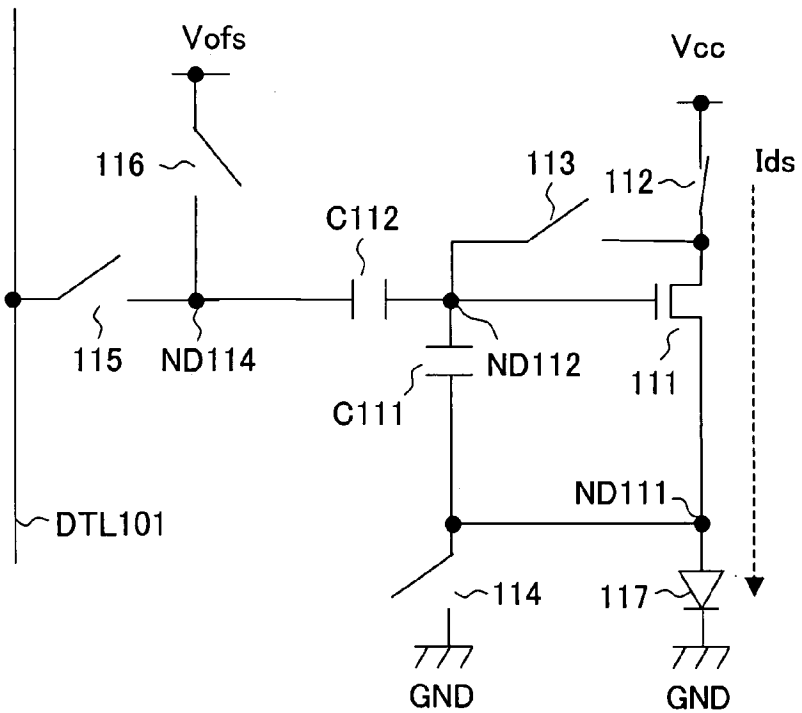

As a result, in each pixel circuit 101, as shown in FIG. 18A, the TFT 112 is held in the on state (conductive state) and the TFT 113 to TFT 116 are held in the off state (non-conductive state).

The drive transistor 111 is designed to operate in the saturated region. The current Ids flowing to the EL light emitting element 117 takes the value shown by the above equation 1.

Next, in the non-emitting period Tne of the EL light emitting element 117, as shown in FIGS. 17A to 17D, the scanning signal ws[1] to the scanning line WSL101 is held at the low level by the write scanner 104, the auto zero signal az[1] to the auto zero line AZL101 is held at the low level by the auto zero circuit 107, the drive signal ds[1] to the drive line DSL101 is held at the low level by the drive scanner 105 and, in that state, the drive signal ds[2] to the drive line DSL111 is set to the low level by the drive scanner 106.

As a result, in each pixel circuit 101, as shown in FIG. 11B, the TFT 112 to TFT 116 are held in the off state, and the TFT 112 is turned off.

By the TFT 112 turning off, the drain voltage of the TFT 111 falls to the source voltage. Due to this, current no longer flows to the EL light emitting element 117, and the potential of the first node ND111 falls to the threshold voltage Ve of the EL light emitting element. Further, the EL light emitting element 117 does not emit light.

Next, in the non-emitting period Tne of the EL light emitting element 117, as shown in FIGS. 17A to 17D, the scanning signal ws[1] to the scanning line WSL101 is held at the low level by the write scanner 104, the drive signal ds[2] to the drive line DSL111 is held at the low level by the drive scanner 106, the auto zero signal az[1] to the auto zero line AZL101 is held at the low level by the auto zero circuit 107, and in that state, the drive signal ds[1] to the drive line DSL101 is set to the high level by the drive scanner 105, then, as shown in FIG. 17D, the auto zero signal az[1] to the auto zero line AZL101 is set to the high level by the auto zero circuit 107.

Figure 19B:
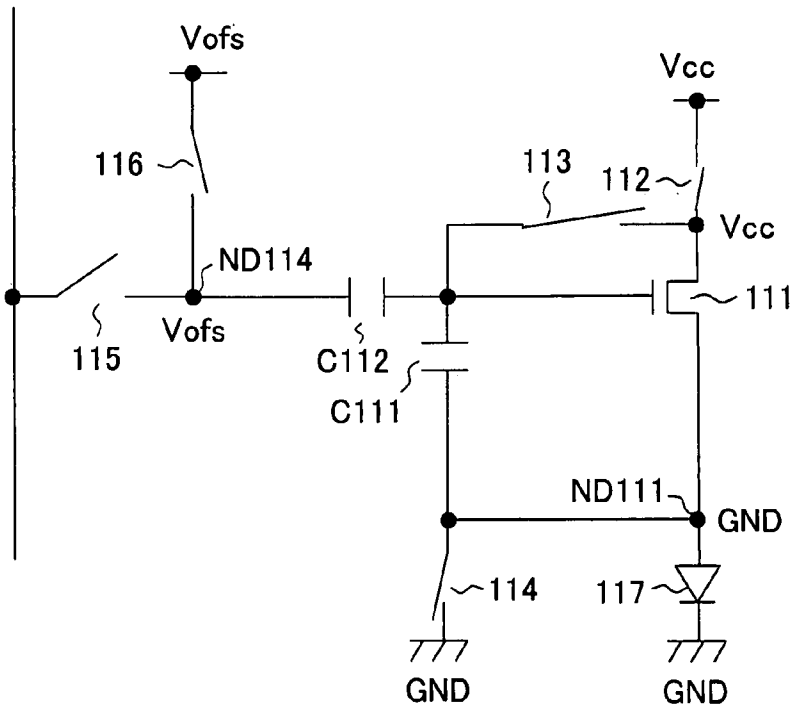
FIG. 19A and FIG. 19B are views for explaining the operation according to a third method of driving the circuit of FIG. 9.
Figure 19A:
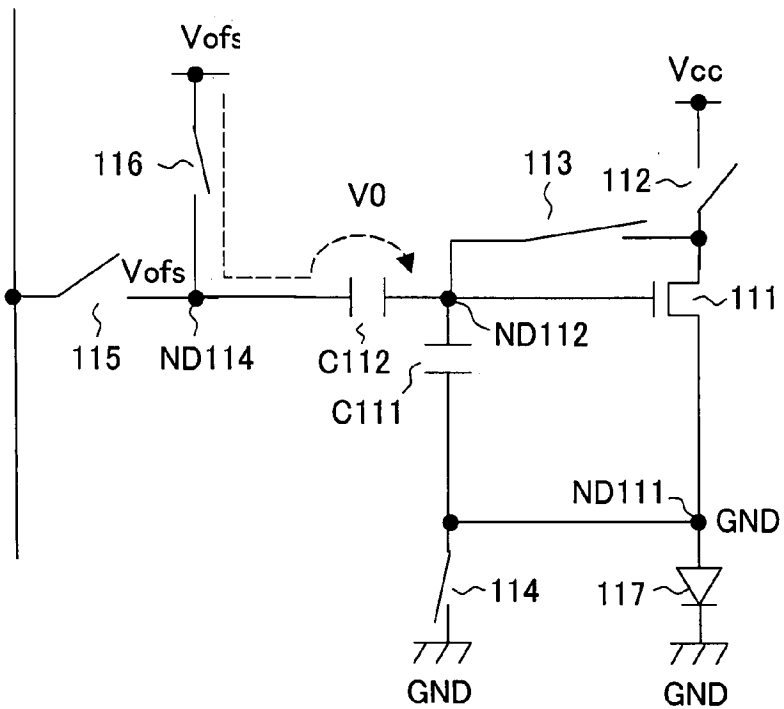

As a result, in each pixel circuit 101, as shown in FIG. 19A, the TFT 112 and TFT 115 are held in the off state, the TFT 114 is turned on, and the TFT 113 and TFT 116 are turned on.

By the TFT 114 turning on, the potential of the first node ND111 becomes the ground potential GND level, and the drain voltage of the TFT 111 becomes the ground potential GND level.

Further, by the TFT 113 and TFT 116 turning on, the change in potential of the fourth ND114 is coupled with the gate of the TFT 111 through the capacitor C112 and the voltage Vgd changes between the gate and drain of the TFT 111. The amount of coupling is made V0.

Note that the timing for turning on the TFT 114, TFT 113, and TFT 116 may be to turn on the TFT 113 and TFT 116, then turn on the TFT 114. That is, it is also possible to connect the gate and drain of the TFT 111, couple the change in potential of the fourth node ND114 to the gate of the TFT 111, then lower the gate of the TFT 111 to the ground potential GND level.

Next, as shown in FIGS. 17A to 17D, the scanning signal ws[1] to the scanning line WSL101 is held at the low level by the write scanner 104, the drive signal ds[1] to the drive line DSL101 is held at the high level by the drive scanner 105, the auto zero signal az[1] to the auto zero line AZL101 is held at the high level by the auto zero circuit 107 and in that state, the drive signal ds[2] to the drive line DSL111 is set to the high level by the drive scanner 106.

As a result, in each pixel circuit 101, as shown in FIG. 19B, the TFT 114, TFT 113, and TFT 116 are held in the on state, the TFT 115 is held in the off state, and the TFT 112 is turned on. Due to this, the gate-drain voltage of the TFT 111 rises to the power source voltage VCC.

Further, the gate-drain voltage of the TFT 111 rises to the power source voltage VCC, then, as shown in FIG. 17C, the drive signal ds[2] to the drive line DSL111 is set to the low level by the drive scanner 106.

Figure 20B:
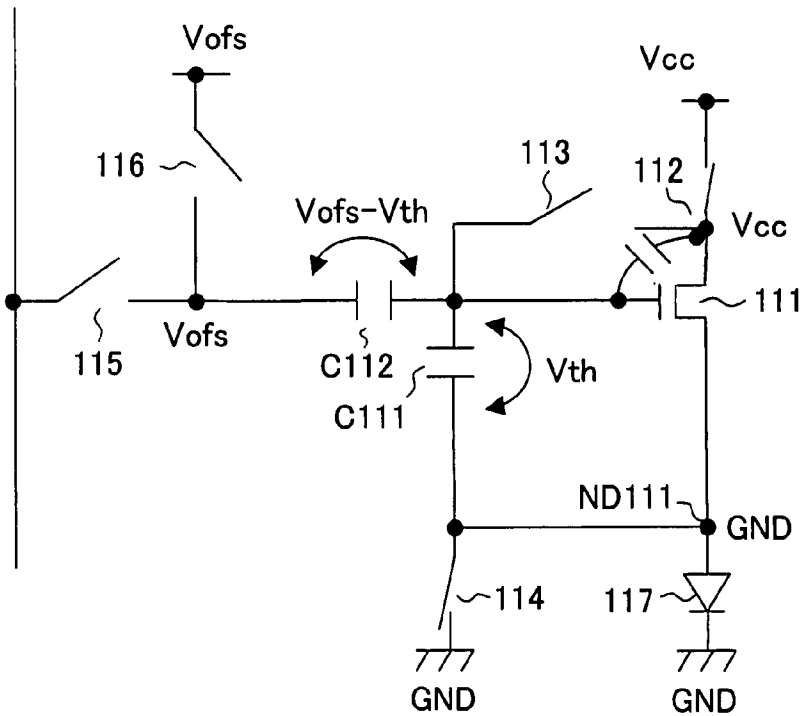
FIG. 20A and FIG. 20B are views for explaining the operation according to a third method of driving the circuit of FIG. 9.
Figure 20A:
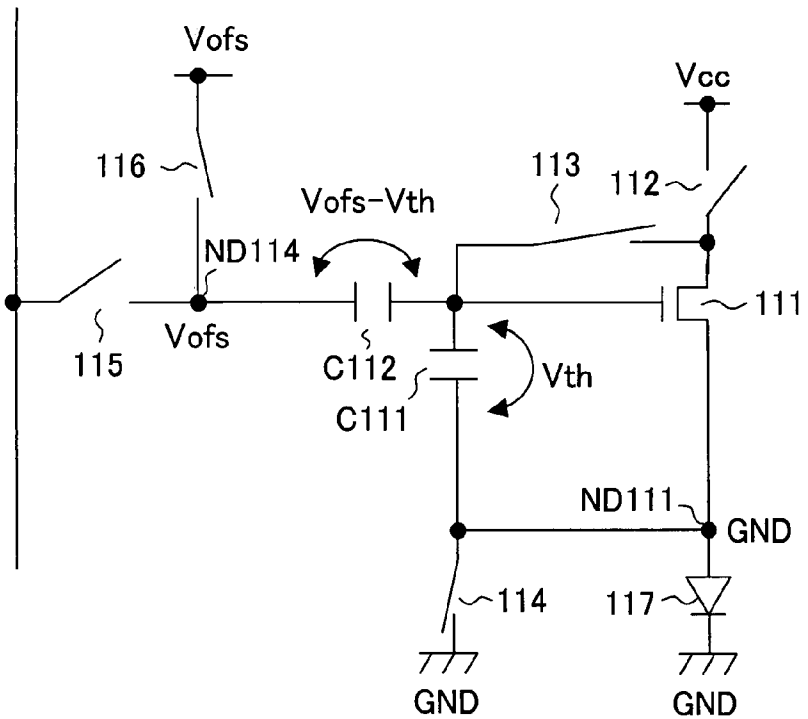

As a result, in each pixel circuit 101, as shown in FIG. 20A, the TFT 114, TFT 113, and TFT 116 are held in the on state, the TFT 115 is held in the off state, and the TFT 112 is turned off.

After the elapse of a predetermined time from when the TFT 112 turns off, the gate-source voltage Vgs of the TFT 111 becomes the threshold voltage Vth of the TFT 11.

At this time, the capacitor C112 is charged with (Vofs−Vth) and the capacitor C111 is charged with Vth.

Next, as shown in FIGS. 17A to 17D, the scanning signal ws[1] to the scanning line WSL101 is held at the low level by the write scanner 104, the drive signal ds[1] to the drive line DSL101 is held at the high level by the drive scanner 105, the drive signal ds[2] to the drive line DSL111 is held at the low level by the drive scanner 106, and, in that state, the auto zero signal az[1] to the auto zero line AZL101 is set to the low level by the auto zero circuit 107, then the drive signal ds[2] to the drive line DSL111 is set to the high level by the drive scanner 106.

As a result, in each pixel circuit 101, as shown in FIG. 20B, the TFT 114 is held in the on state, the TFT 113 and TFT 116 are turned off, and the TFT 112 is turned from off to on.

By this, the drain voltage of the TFT 111 becomes the power source voltage once again.

Next, as shown in FIGS. 17A to 17D, the drive signal ds[1] to the drive line DSL101 is held at the high level by the drive scanner 105, the drive signal ds[2] to the drive line DSL111 is held at the high level by the drive scanner 106, the auto zero signal az[1] to the auto zero line AZL101 is held at the low level by the auto zero circuit 107, and, in that state, the scanning signal ws[1] to the scanning line WSL101 is set to the high level by the write scanner 104.

Figure 21B:
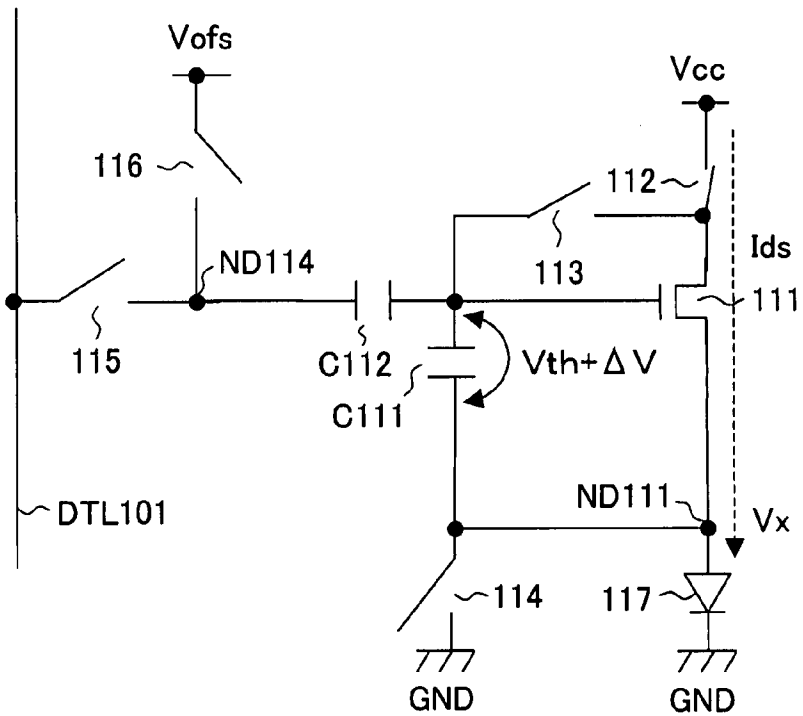
FIG. 21A and FIG. 21B are views for explaining the operation according to a third method of driving the circuit of FIG. 9.
Figure 21A:
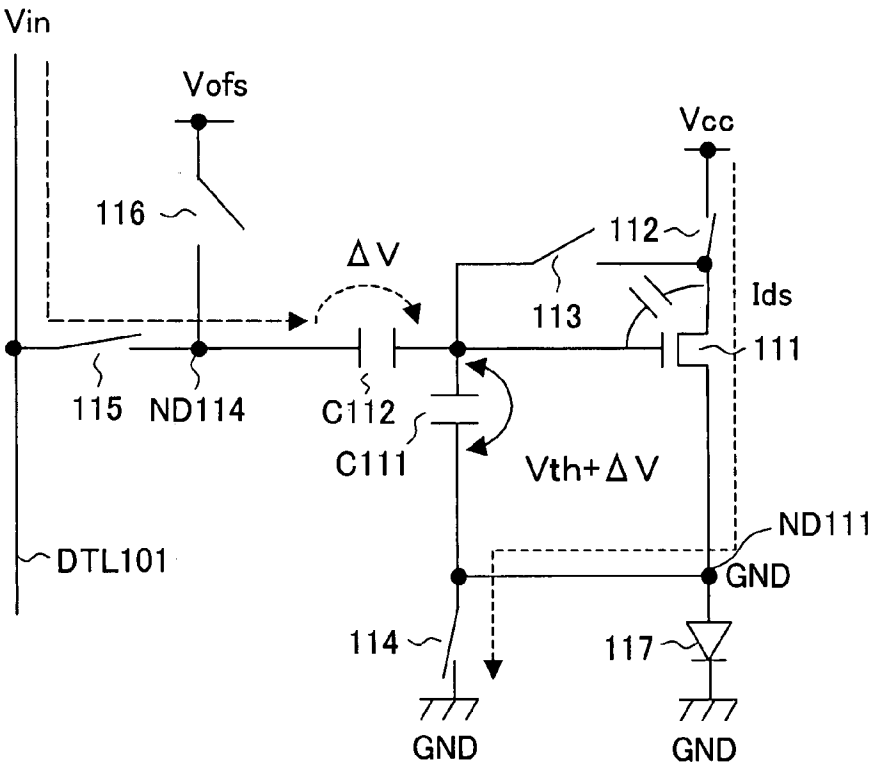

As a result, in each pixel circuit 101, as shown in FIG. 21A, the TFT 114 and the TFT 112 are held in the on state, the TFT 113 and TFT 116 are held in the off state, and the TFT 115 is turned on.

Due to this, the input voltage Vin propagated through the data line DTL101 is input through the TFT 115, while the voltage change amount ΔV of the node ND114 is coupled with the gate of the TFT 111.

At this time, the gate voltage Vg of the TFT 111 is a value of Vth, while the coupling amount ΔV is determined as in the above equation 2 by the capacity C1 of the capacitor C111, the capacity C2 of the capacitor C112, and the parasitic capacity C3 of the TFT 111.

Therefore, as explained above, if making C1 and C2 sufficiently larger than C3, the amount of coupling to the gate is determined by only the capacity C1 of the capacitor C111 and the capacity C2 of the capacitor C112. The TFT 111 is designed to operate in the saturated region, so a current Ids in accordance with the gate-source voltage Vgs of the TFT 111 flows.

After the writing ends, as shown in FIG. 17A to FIG. 17D, the drive signal ds[2] to the drive line DSL111 is held at the high level by the drive scanner 106, the auto zero signal az[1] to the auto zero line AZL101 is held at the low level by the auto zero circuit 107, and, in that state, the scanning signal ws[1] to the scanning line WSL101 is set to the low level by the write scanner 104, then the drive signal ds[1] to the drive line DSL101 is set to the low level by the drive scanner 105.

As a result, in each pixel circuit 101, as shown in FIG. 21B, the TFT 112 is held in the on state, the TFT 113 and TFT 116 are held in the off state, the TFT 115 is turned off, and the TFT 114 is turned off.

In this case, even if the TFT 114 turns off, the gate-source voltage of the TFT 111 is constant, so the TFT 111 runs a constant current Ids to the EL light emitting element 117. Due to this, the potential of the first node ND111 is boosted to the voltage Vx at which the current Ids runs to the EL light emitting element 117, and the EL light emitting element 117 emits light.

Here, in this circuit as well, the EL light emitting element ends up changing in current-voltage (I-V) characteristic when the emitting period becomes longer. Therefore, the potential of the first node ND111 also changes. However, the gate-source voltage Vgs of the TFT 111 is held at a constant value, so the current flowing to the EL light emitting element 117 does not change. Accordingly, even if the I-V characteristic of the EL light emitting element 117 deteriorates, the constant current Ids continues to flow and the luminance of the EL light emitting element 117 does not change.

The above was the third method of driving the pixel circuit of FIG. 9. As shown in FIG. 22A to FIG. 22D, however, it is also possible to employ a fourth method of driving setting the timing for turning on the TFT 112 to after turning on the TFT 115.

However, as explained above, if turning on the TFT 115, then turning on the TFT 112, the TFT 111 operates from the linear region to the saturated region.

On the other hand, if turning on the TFT 112, then turning on the TFT 115 as with the third method of driving, the TFT 111 operates in only the saturated region. The transistor has a shorter channel length in the saturated region than the linear region, so the parasitic capacity C3 is small.

Accordingly, turning the TFT 112 on, then turning the TFT 115 on as with the third method of driving enables the parasitic capacity C3 of the TFT 111 to be made smaller than when turning off the TFT 115, then turning on the TFT 112 like with the fourth method of driving.

If it is possible to make the parasitic capacity C3 small, when turning on the TFT 112, the amount of coupling from the drain to the gate of the TFT 111 can be made smaller and the capacity C1 of the capacitor C111 and the capacity C2 of the capacitor C112 can be made sufficiently larger than the parasitic capacity C3, so the change in the voltage of the fourth node ND114 when turning the TFT 115 on is coupled to the gate of the TFT 111 in accordance with the magnitudes of the C1 and C2.

Due to this, the third method of driving can be said to be better than the fourth method of driving.

As explained above, according to the first embodiment, there is provided a voltage drive type TFT active matrix organic EL display where a capacitor C111 is connected between the gate and source of the TFT 111 as the drive transistor, the source side of the TFT 111 (first node ND111) is connected to a fixed potential through the TFT 114 (in the present embodiment, the GND), the gate and drain of the TFT 111 are connected through the TFT 113 to cancel the threshold value Vth, the capacitor C111 is charged with that threshold value Vth, and the input voltage Vin is coupled with the gate of the TFT 111 from that threshold value Vth, so the following effects can be obtained.

The threshold voltage of the TFT 111 as the drive transistor can be easily cancelled, so it is possible to reduce the variations in current of the pixels and possible to obtain uniform image quality.

Further, it is possible to reduce the current flowing in a pixel in the non-emitting period by setting the timings of the switching transistors and possible to realize lower power consumption.

Source-follower output with no deterioration in luminance even with a change in the I-V characteristic of an EL element along with elapse becomes possible.

A source-follower circuit of n-channel transistors becomes possible, so it is possible to use an n-channel transistor as a drive element of an EL light emitting element while using current anode-cathode electrodes.

Further, it is possible to configure transistors of a pixel circuit by only n-channel transistors and possible to use the a-Si process in the fabrication of the TFTs. Due to this, there is the advantage that a reduction of the cost of TFT boards becomes possible.

Second Embodiment

Figure 23:
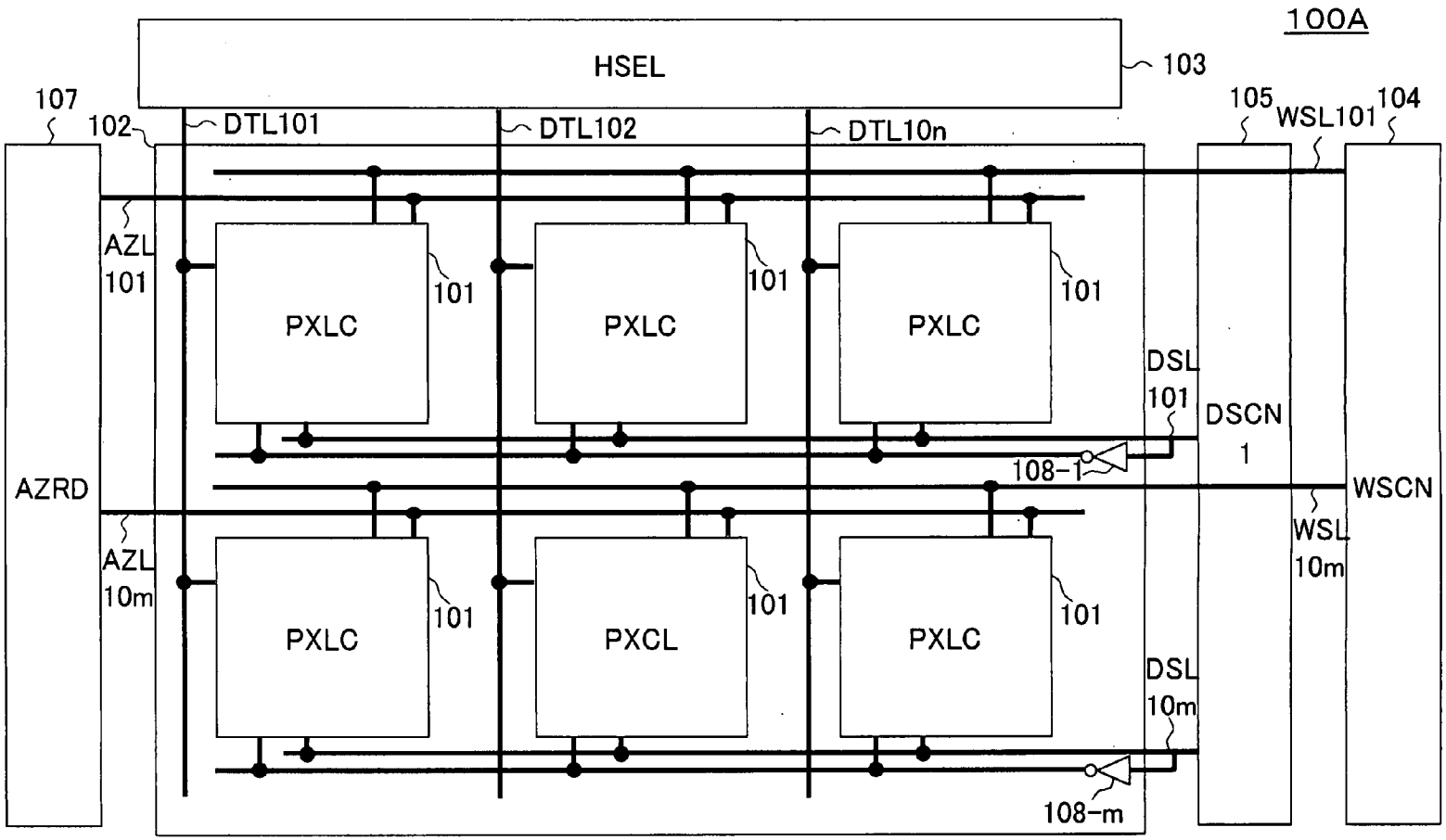
FIG. 23 is a block diagram of the configuration of an organic EL display device employing a pixel circuit according to a second embodiment.

FIG. 23 is a block diagram of the configuration of an organic EL display device employing pixel circuits according to a second embodiment.

Figure 24:
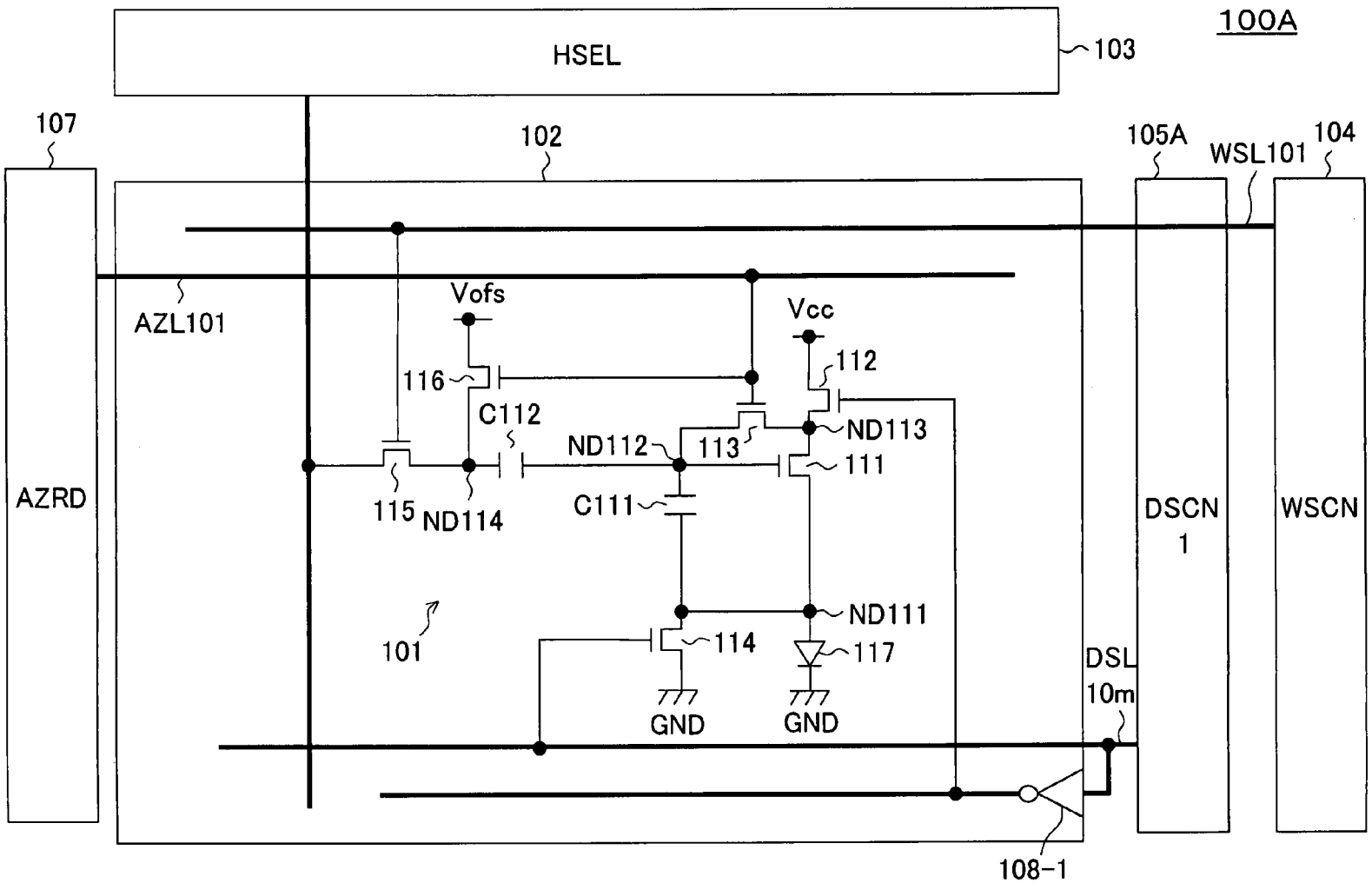
FIG. 24 is a circuit diagram of a specific configuration of a pixel circuit according to the second embodiment in the organic EL display device of FIG. 23.

FIG. 24 is a circuit diagram of the concrete configuration of a pixel circuit according to the second embodiment in the organic EL display device of FIG. 23.

The difference of the second embodiment from the above first embodiment is that a single drive scanner is used, the drive signal ds[1] applied to the drive lines DSL101 to DSL10*m* is supplied to the gate of the TFT 114, and the inverted signal/ds[1] of the drive signal ds[1] due to the inverters 108-1 to 108-m is supplied to the gate of the TFT 112.

Therefore, in the second embodiment, the TFT 112 and TFT 114 are complementarily turned on and off. That is, when the TFT 112 is on, the TFT 114 is held off, while when the TFT 112 is off, the TFT 114 is held on.

The operation of the second embodiment will be explained with reference to FIG. 25A to FIG. 25D, FIGS. 26A and 26B, FIGS. 27A and 27B, and FIG. 28.

First, in the ordinary emitting period of the EL light emitting element 117, as shown in FIGS. 25A to 25D, the scanning signal ws[1] to the scanning line WSL101 is set to the low level by the write scanner 104, the drive signal ds[1] to the drive line DSL101 is set to the low level by the drive scanner 105, and the auto zero signal az[1] to the auto zero line AZL101 is set to the low level by the auto zero circuit 107.

Figure 26B:
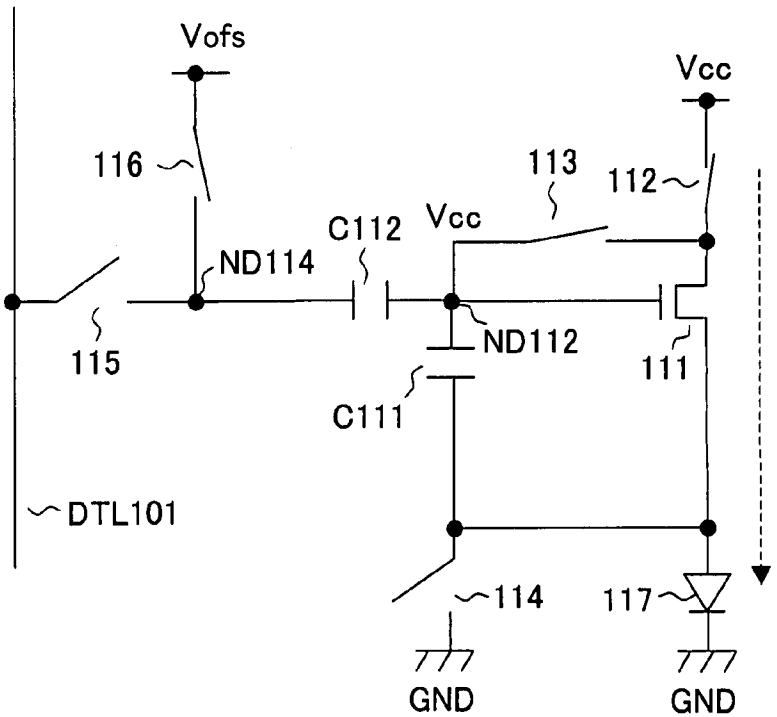
FIG. 26A and FIG. 26B are views for explaining the operation according to a method of driving the circuit of FIG. 24.
Figure 26A:
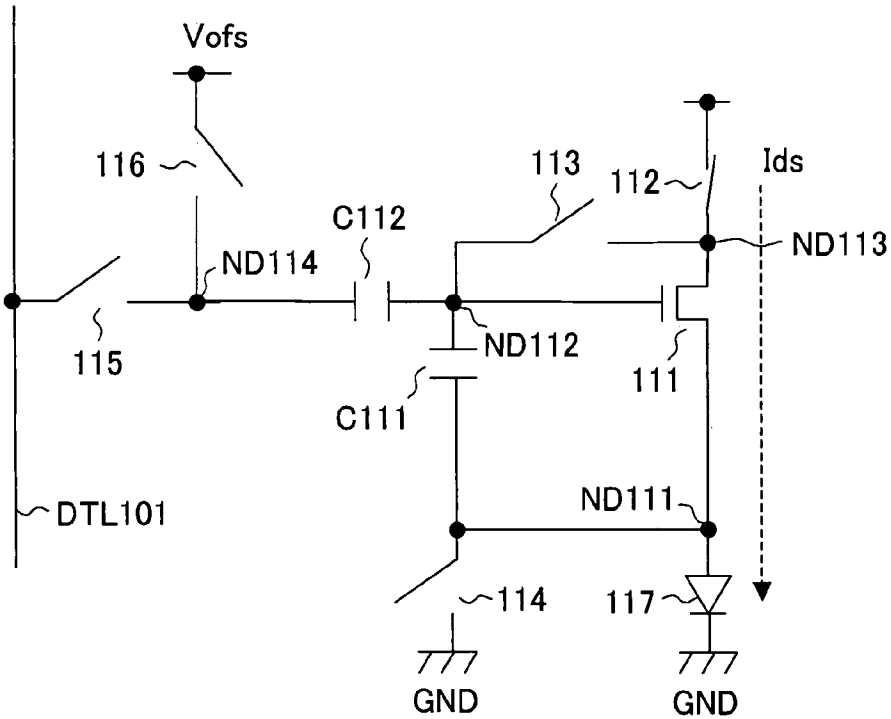

As a result, in each pixel circuit 101, as shown in FIG. 26A, the TFT 112 is held in the on state (conductive state), the TFT 113 to TFT 116 are held in the off state (non-conductive state).

The drive transistor 111 is designed to operate in the saturated region. The current Ids flowing to the EL light emitting element 117 takes the value shown by the above equation 1.

Next, in the non-emitting period Tne of the EL light emitting element 117, as shown in FIGS. 25A to 25D, the scanning signal ws[1] to the scanning line WSL101 is held at the low level by the write scanner 104, the drive signal ds[1] to the drive line DSL101 is held at the low level by the drive scanner 105, and the auto zero signal az[1] to the auto zero line AZL101 is set to the high level by the auto zero circuit 107.

As a result, in each pixel circuit 101, as shown in FIG. 26B, the TFT 112 is held in the on state, the TFT 114 and TFT 115 are held in the off state, and the TFT 113 and TFT 116 are turned on.

By the TFT 113 turning on, the drain and gate of the TFT 111 are connected and the voltage rises to the power source voltage. Further, by the TFT 116 turning on, the change in potential of the fourth node ND114 is coupled with the gate of the TFT 111 through the capacitor C112 and the gate-drain voltage Vgd of the TFT 111 changes.

Next, as shown in FIGS. 25A to 25D, the scanning signal ws[1] to the scanning line WSL101 is held at the low level by the write scanner 104, the auto zero signal az[1] to the auto zero line AZL101 is held at the high level by the auto zero circuit 107 and, in that state, the drive signal ds[1] to the drive line DSL101 is set to the high level by the drive scanner 105.

Figure 27B:
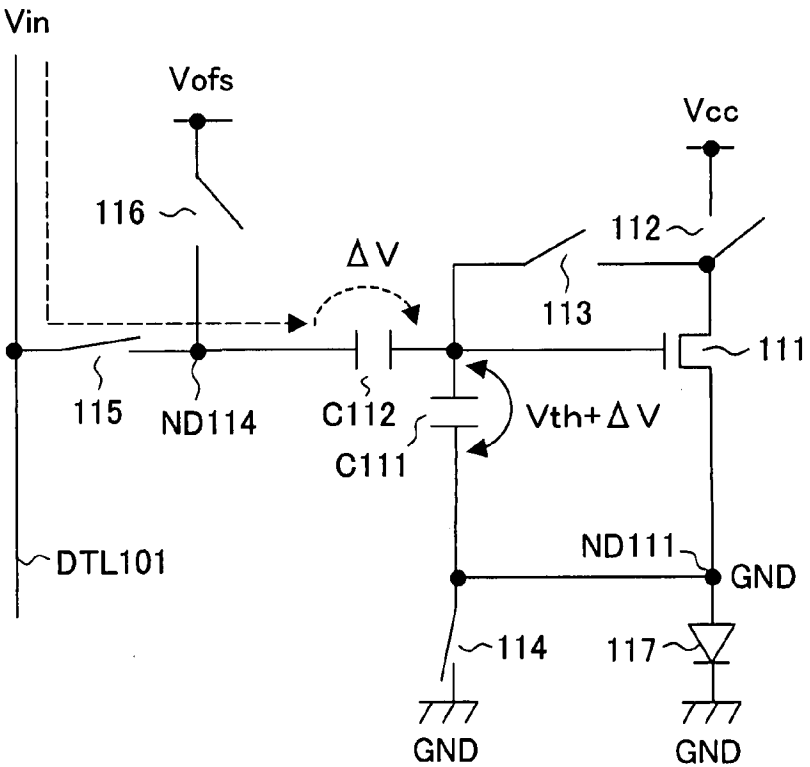
FIG. 27A and FIG. 27B are views for explaining the operation according to a method of driving the circuit of FIG. 24.
Figure 27A:
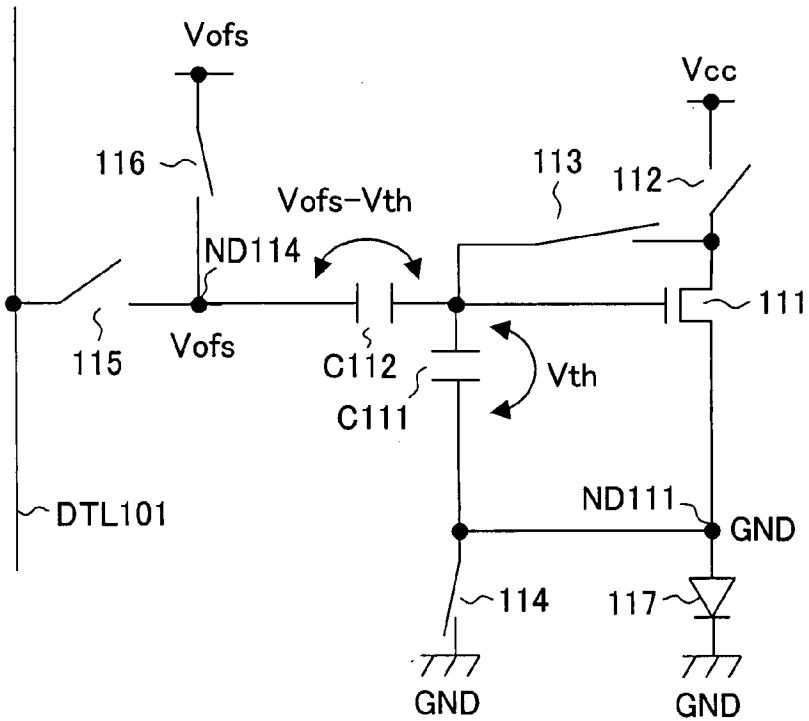

As a result, in each pixel circuit 101, as shown in FIG. 27A, the TFT 114, TFT 113, and TFT 116 are held in the on state, and the TFT112 and TFT 115 are held in the off state.

Due to this, the potential of the first node ND111 (source potential of TFT 111) falls to the ground potential GND level. Further, the gate-source voltage Vgs of the TFT 111 becomes the threshold voltage Vth of the TFT 111 after the elapse of a predetermined time.

At this time, the capacitor C112 is charged with (Vofs−Vth) and the capacitor C111 is charged with Vth.

Next, as shown in FIGS. 25A to 25D, the scanning signal ws[1] to the scanning line WSL101 is held at the low level by the write scanner 104, the drive signal ds[1] to the drive line DSL101 is held at the high level by the drive scanner 105, and, in that state, the auto zero signal az[1] to the auto zero line AZL101 is set to the low level by the auto zero circuit 107, then the scanning signal ws[1] to the scanning line WSL101 is set to the high level by the write scanner 104.

As a result, in each pixel circuit 101, as shown in FIG. 27B, the TFT 114 is held in the on state, the TFT 112 is held in the off state, the TFT 113 and TFT 116 are turned off, and the TFT 115 is turned on.

Due to this, the input voltage Vin propagated through the data line DTL 101 through the TFT 115 is input, and the voltage change amount ΔV of the node ND114 is coupled to the gate of the TFT 111.

At this time, the drain end of the TFT 111 is floating, so the amount of coupling ΔV to the TFT 111 is determined by only the capacity C1 of the capacitor C111 and the capacity C2 of the capacitor C112.

After the writing ends, as shown in FIG. 25A to FIG. 25D, the auto zero signal az[1] to the auto zero line AZL101 is held at the low level by the auto zero circuit 107, and, in that state, the scanning signal ws[1] to the scanning line WSL101 is set to the low level by the write scanner 104, then the drive signal ds[1] to the drive line DSL101 is set to the low level by the drive scanner 105.

Figure 28:
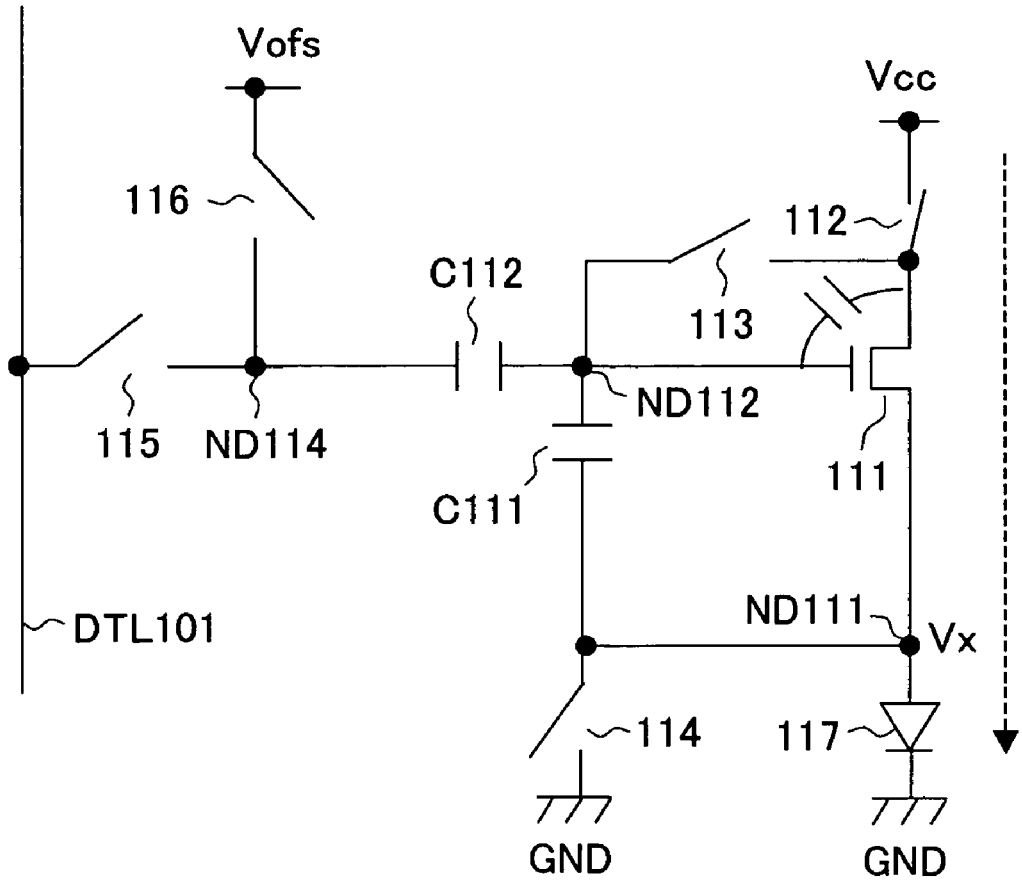
FIG. 28 is a view for explaining the operation according to a method of driving the circuit of FIG. 24.

As a result, in each pixel circuit 101, as shown in FIG. 28, the TFT 113 and the TFT 116 are held in the off state, the TFT 115 and TFT 114 are turned off, and the TFT 112 is turned on.

Due to this, the drain voltage of the TFT 111 rises to the power source voltage.

In this case, even if the TFT 114 turns off, the gate-source voltage of the TFT 111 is constant, so the TFT 111 runs a constant current Ids to the EL light emitting element 117. Due to this, the potential of the first node ND111 is boosted to the voltage Vx at which the current Ids runs to the EL light emitting element 117, and the EL light emitting element 117 emits light.

Here, in this circuit as well, the EL light emitting element ends up changing in current-voltage (I-V) characteristic when the emitting period becomes longer. Therefore, the potential of the first node ND111 also changes. However, the gate-source voltage Vgs of the TFT 111 is held at a constant value, so the current flowing to the EL light emitting element 117 does not change. Accordingly, even if the I-V characteristic of the EL light emitting element 117 deteriorates, the constant current Ids continues to flow and the luminance of the EL light emitting element 117 does not change.

According to the second embodiment, the threshold voltage of the TFT 111 as the drive transistor can be easily cancelled, so it is possible to reduce the variations in current of the pixels and possible to obtain uniform image quality.

Further, it is possible to reduce the current flowing in a pixel in the non-emitting period by setting the timings of the switching transistors and possible to realize lower power consumption.

Source-follower output with no deterioration in luminance even with a change in the I-V characteristic of an EL light emitting element along with elapse becomes possible.

A source-follower circuit of n-channel transistors becomes possible, so it is possible to use an n-channel transistor as a drive element of an EL light emitting element while using current anode-cathode electrodes.

Further, it is possible to configure transistors of a pixel circuit by only n-channel transistors and possible to use the a-Si process in the fabrication of the TFTs. Due to this, a reduction of the cost of TFT boards becomes possible.

Third Embodiment

Figure 29:
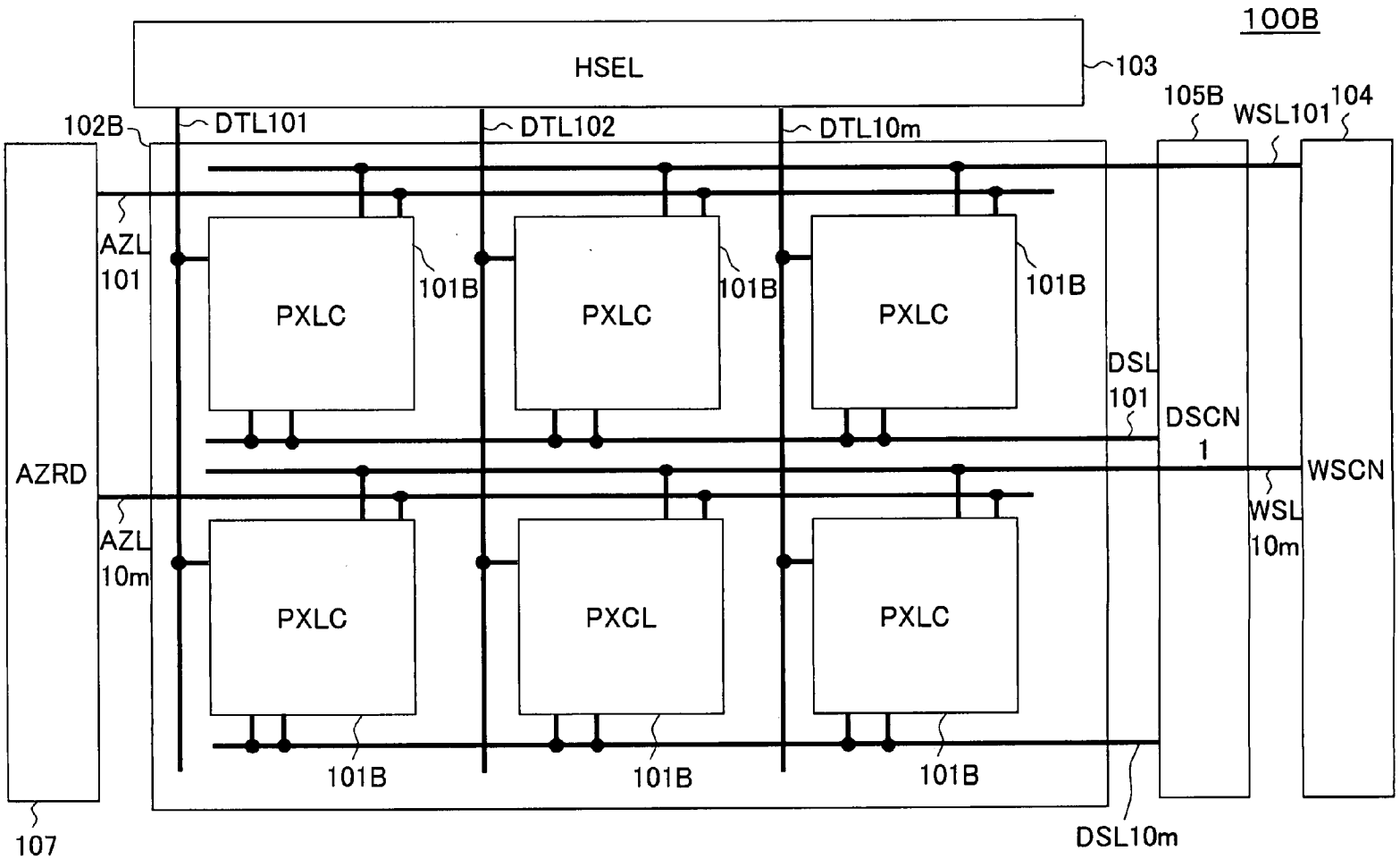
FIG. 29 is block diagram of the configuration of an organic EL display device employing a pixel circuit according to a third embodiment.

FIG. 29 is a block diagram of the configuration of an organic EL display device employing pixel circuits according to a third embodiment.

Figure 30:
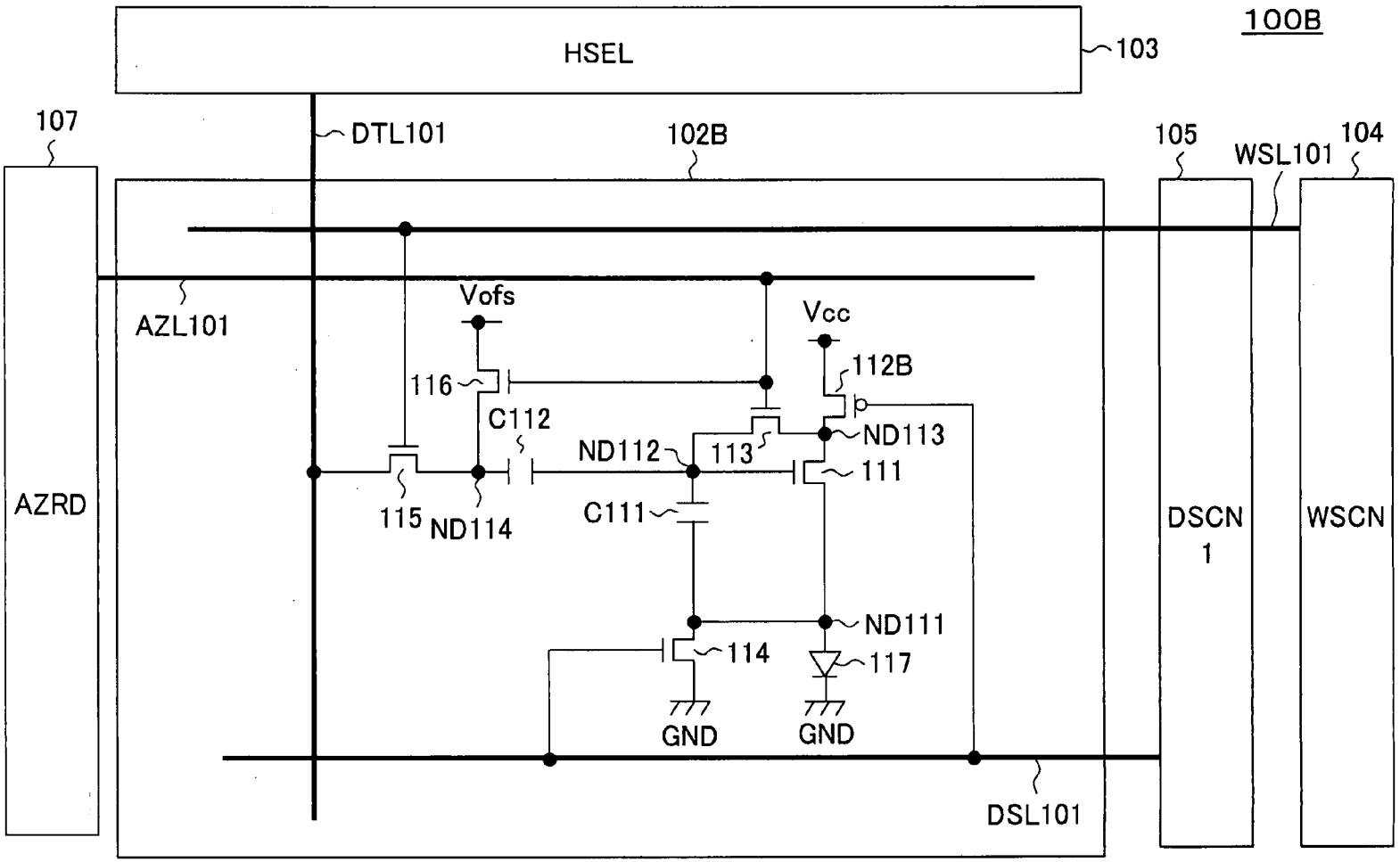
FIG. 30 is a circuit diagram of a specific configuration of a pixel circuit according to the third embodiment in the organic EL display device of FIG. 29.

FIG. 30 is a circuit diagram of the concrete configuration of a pixel circuit according to the third embodiment in the organic EL display device of FIG. 20.

The difference of the display device 100B according to the third embodiment from the display device 100A according to the second embodiment lies in the use of the p-channel TFT 112B instead of the n-channel TFT for the TFT 112 as the first switch in the pixel circuit.

Figure 31:
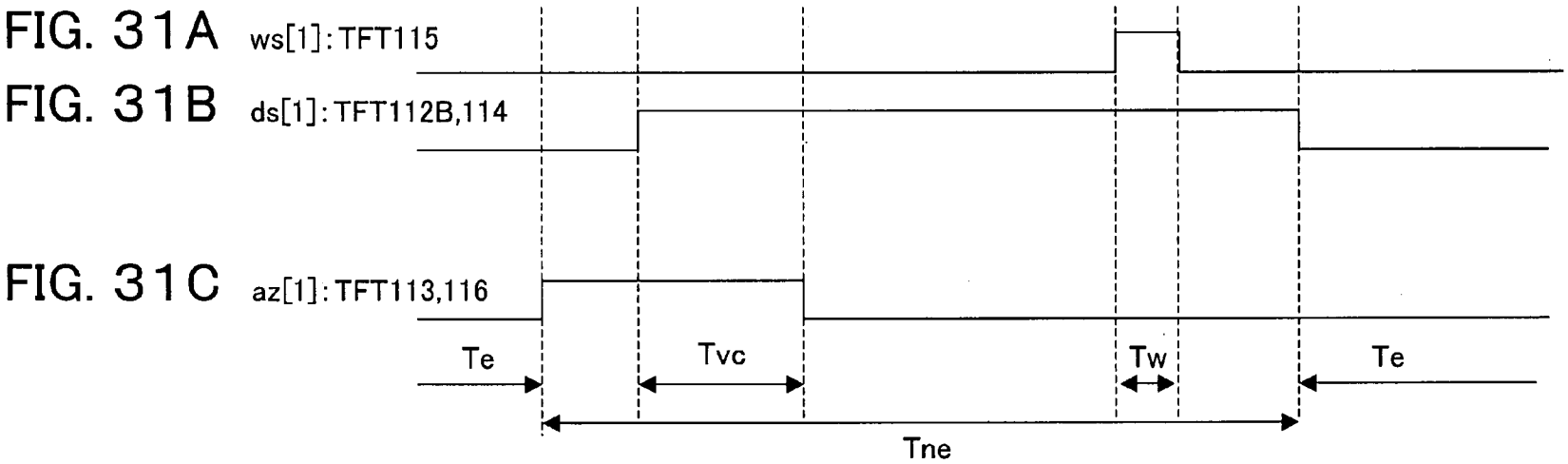
FIGS. 31A to 31C are timing charts for explaining a method of driving the circuit of FIG. 30.

In this case, the TFT 112B and TFT 114 need only be complementarily turned on and off, so as shown in FIG. 31A to FIG. 31C, it is sufficient to apply only the drive signal ds[1] to one drive line DSL101 to DSL10*m* of each row.

Therefore, like in the second embodiment, there is no need to provide an inverter.

The rest of the configuration is similar to above second embodiment.

According to the third embodiment, in addition to the effects of the second embodiment, there is the advantage that it is possible to simplify the circuit configuration.

Fourth Embodiment

Figure 32:
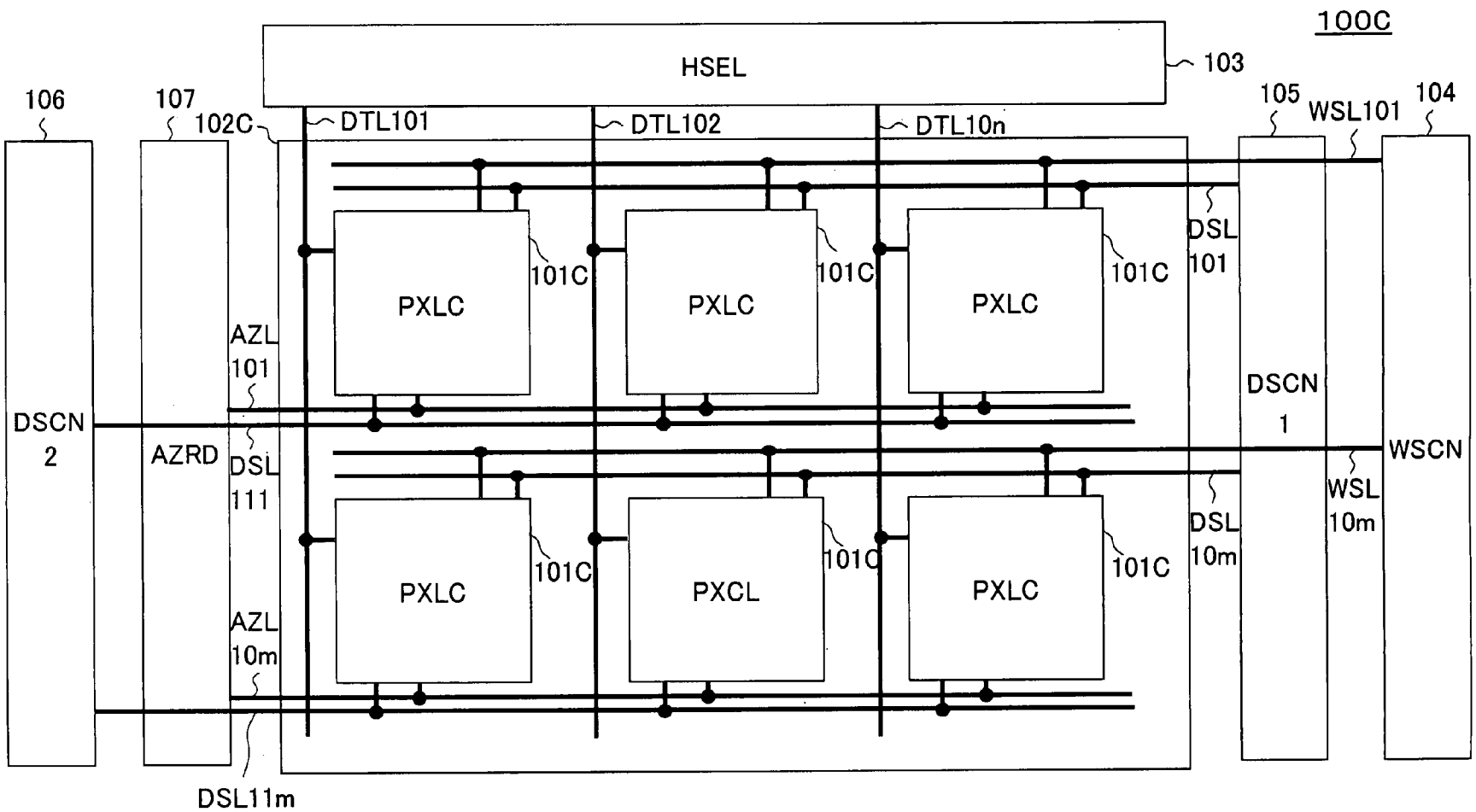
FIG. 32 is block diagram of the configuration of an organic EL display device employing a pixel circuit according to a fourth embodiment.

FIG. 32 is a block diagram of the configuration of an organic EL display device employing pixel circuits according to a fourth embodiment.

Figure 33:
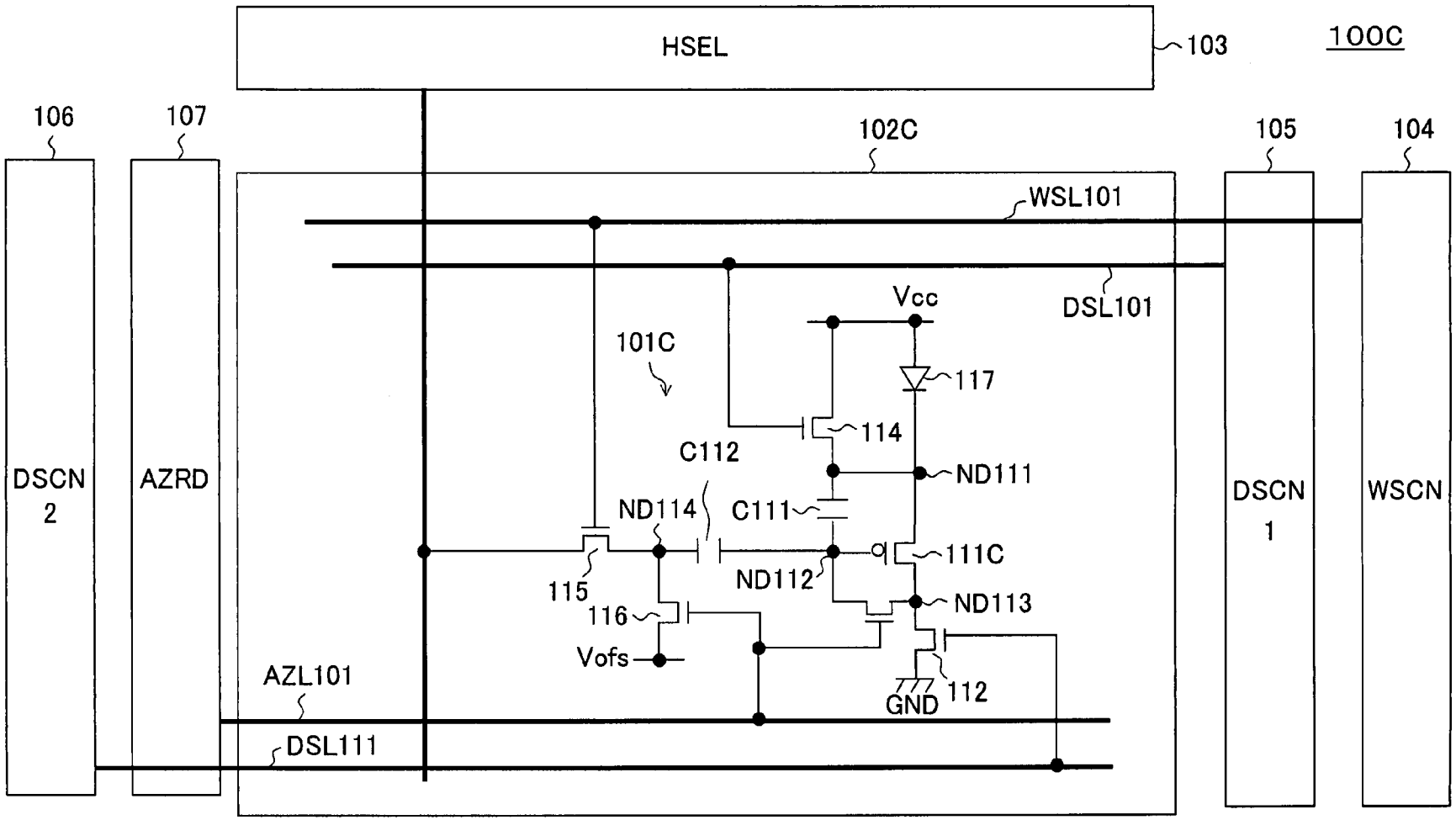
FIG. 33 is a circuit diagram of a specific configuration of a pixel circuit according to the fourth embodiment in the organic EL display device of FIG. 32.

FIG. 33 is a circuit diagram of the concrete configuration of a pixel circuit according to the fourth embodiment in the organic EL display device of FIG. 32.

The difference of the fourth embodiment from the first embodiment is the use of a p-channel TFT 111C instead of an n-channel TFT for the TFT 111 as the drive transistor.

In this case, the anode of the light emitting element 117 is connected to the power source potential VCC, the cathode is connected to the first node ND111, a source of the TFT 111C is connected to the first node ND111, a drain of the TFT 111C is connected to the third node ND113, the drain of the TFT 112 is connected to the third node ND113, and the source of the TFT 112 is connected to the ground potential GND. Further, the TFT 114 is connected between the first node ND111 and the power source potential VCC.

The rest of the connections are similar to those of the first embodiment. The operation is also similar. Therefore, a detailed explanation will be omitted here.

According to the fourth embodiment, effects similar to the effects of the first embodiment can be obtained.

Fifth Embodiment

Figure 34:
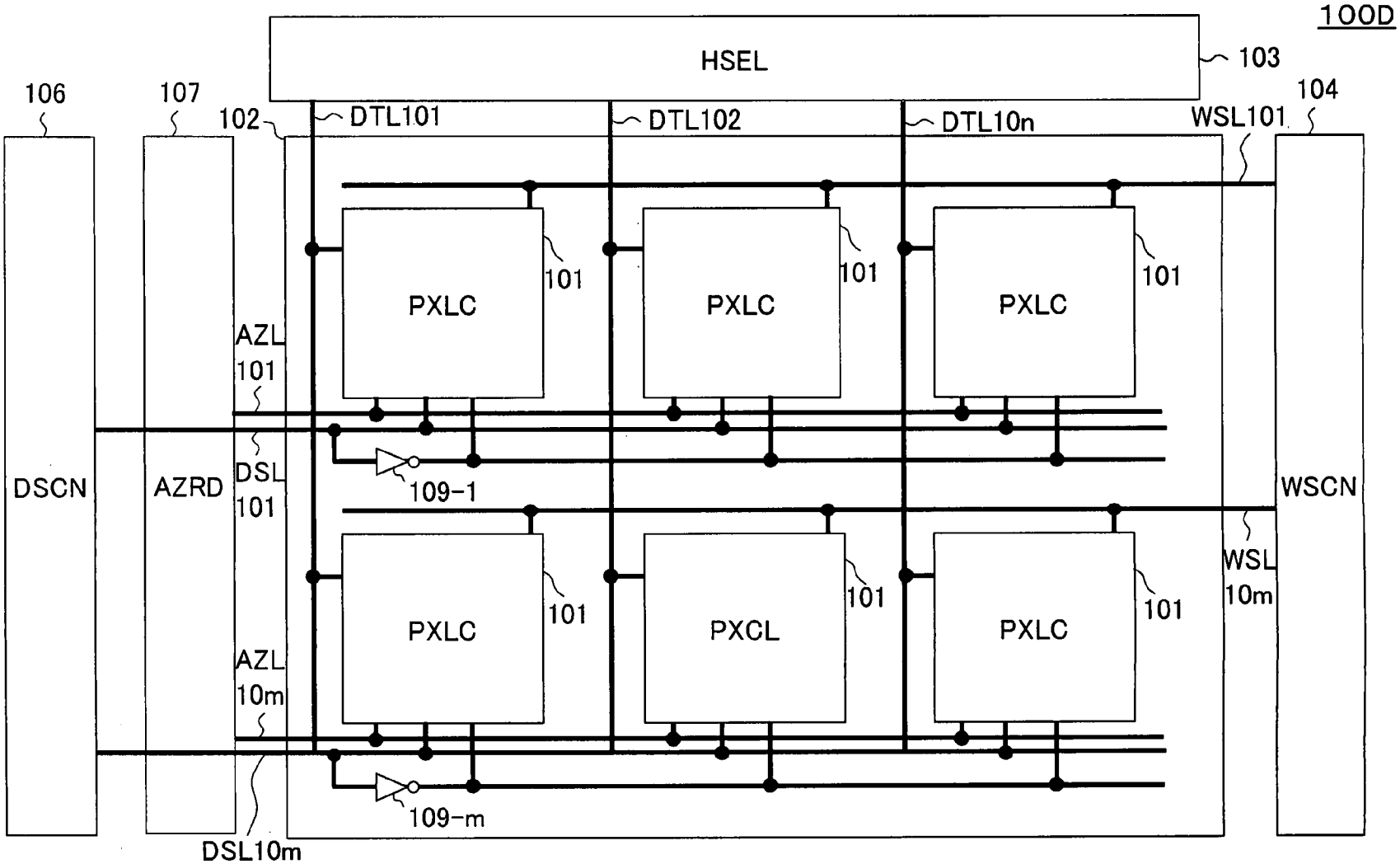
FIG. 34 is block diagram of the configuration of an organic EL display device employing a pixel circuit according to a fifth embodiment.

FIG. 34 is a block diagram of the configuration of an organic EL display device employing pixel circuits according to a fifth embodiment.

Figure 35:
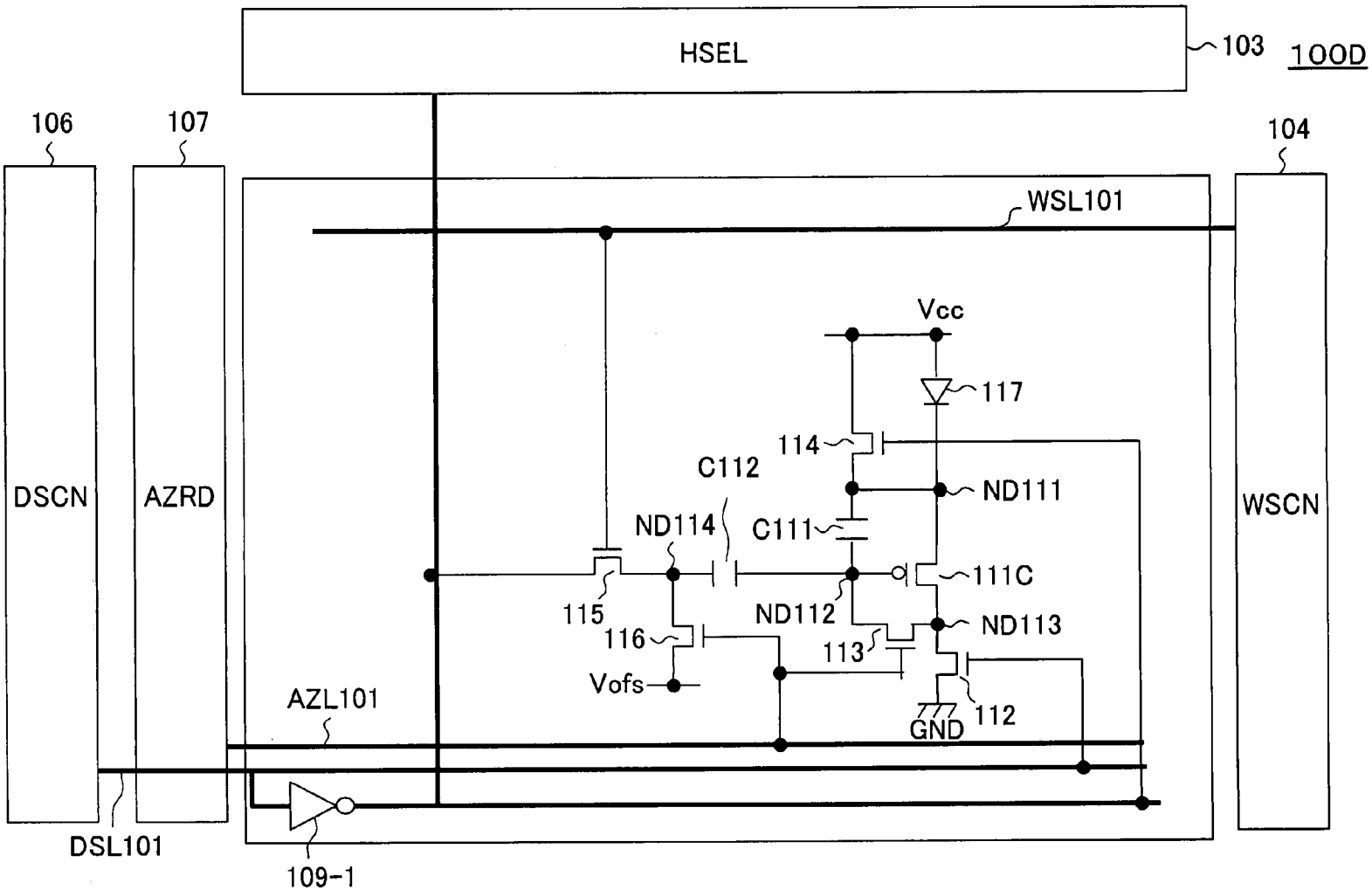
FIG. 35 is a circuit diagram of a specific configuration of a pixel circuit according to the fifth embodiment in the organic EL display device of FIG. 34.

FIG. 35 is a circuit diagram of the concrete configuration of a pixel circuit according to the fifth embodiment in the organic EL display device of FIG. 34.

The difference of the fifth embodiment from the above fourth embodiment is that a single drive scanner is used, the drive signal ds[1] applied to the drive lines DSL101 to DSL10*m* is supplied to the gate of the TFT 112, and the inverted signal/ds[1] of the drive signal ds[1] due to the inverters 109-1 to 109-m is supplied to the gate of the TFT 114.

The rest of the configuration is the same as in the fourth embodiment.

In the fifth embodiment as well, effects similar to the effects of the first embodiment can be obtained.

Sixth Embodiment

Figure 36:
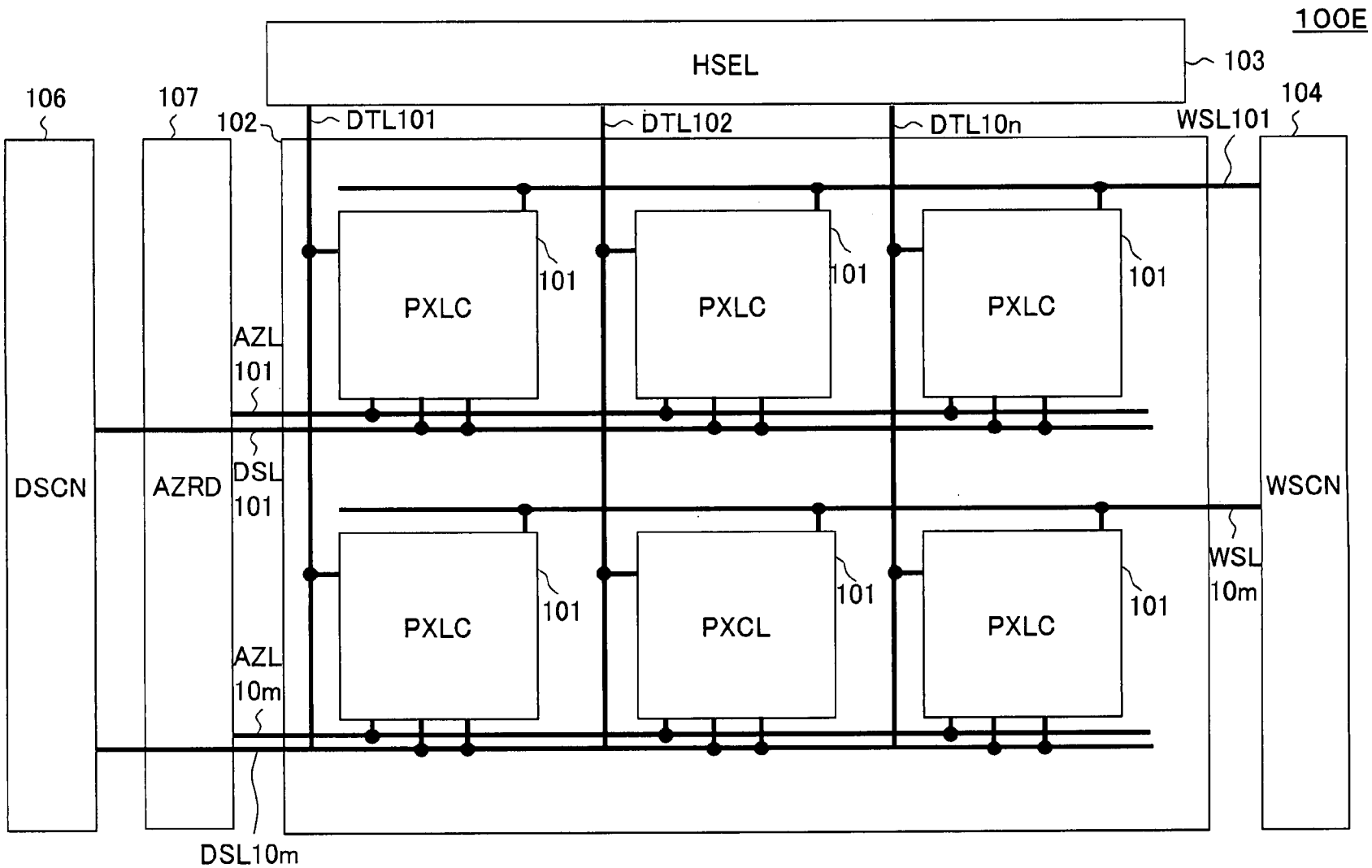
FIG. 36 is block diagram of the configuration of an organic EL display device employing a pixel circuit according to a sixth embodiment.

FIG. 36 is a block diagram of the configuration of an organic EL display device employing pixel circuits according to a sixth embodiment.

Figure 37:
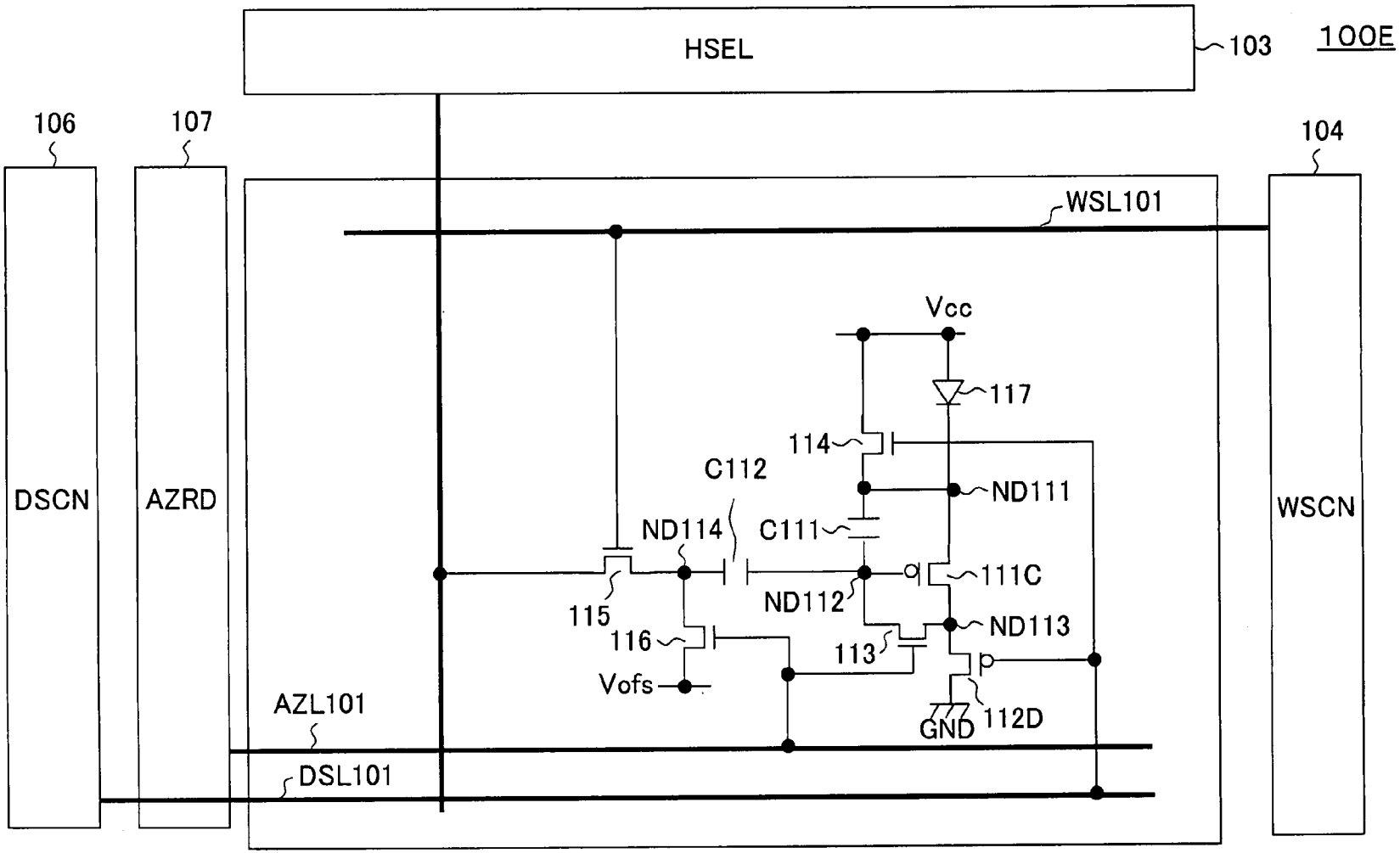
FIG. 37 is a circuit diagram of a specific configuration of a pixel circuit according to the sixth embodiment in the organic EL display device of FIG. 36.

FIG. 37 is a circuit diagram of the concrete configuration of a pixel circuit according to the sixth embodiment in the organic EL display device of FIG. 36.

The difference of the display device 100E according to the sixth embodiment from the display device 100D according to the fifth embodiment lies in the use of the p-channel TFT 112D instead of the n-channel TFT for the TFT 112 as the first switch by in the pixel circuit.

In this case, the TFT 112E and TFT 114 need only be complementarily turned on and off, so it is sufficient to apply only the drive signal ds[1] to one drive line DSL101 to DSL10*m* of each row.

Therefore, like in the fifth embodiment, there is no need to provide an inverter.

The rest of the configuration is similar to above fifth embodiment.

According to the sixth embodiment, in addition to the effects of the first embodiment, there is the advantage that it is possible to simplify the circuit configuration.

As explained above, according to the present invention, the threshold voltage of the drive transistor constituted by the TFT 111 can be easily cancelled, so it is possible to reduce the variations in current of the pixels and possible to obtain uniform image quality.

Further, it is possible to reduce the current flowing in a pixel in the non-emitting period by setting the timings of the switching transistors and possible to realize lower power consumption.

Source-follower output with no deterioration in luminance even with a change in the I-V characteristic of an EL light emitting element along with elapse becomes possible.

A source-follower circuit of n-channel transistors becomes possible, so it is possible to use an n-channel transistor as a drive element of an EL light emitting element while using current anode-cathode electrodes.

Further, it is possible to configure transistors of a pixel circuit by only n-channel transistors and possible to use the a-Si process in the fabrication of the TFTs. Due to this, a reduction of the cost of TFT boards becomes possible.

INDUSTRIAL APPLICABILITY

According to the pixel circuit, display device, and method of driving a pixel circuit of the present invention, source-follower output with no deterioration in luminance even with a change in the current-voltage characteristic of a light emitting element along with elapse becomes possible and a source-follower circuit of n-channel transistors becomes possible, so it is possible to use an n-channel transistor as a drive element of an EL element while using current anode-cathode electrodes, therefore the invention can be applied even to a large-sized and high definition active matrix type display.

LIST OF REFERENCES

100, 100A to 110E . . . display device
101 . . . pixel circuit (PXLC)
102 . . . pixel array portion
103 . . . horizontal selector (HSEL)
104 . . . write scanner (WSCN)
105 . . . first drive scanner (DSCN1)
106 . . . second drive scanner (DSCN2)
DTL101 to DTL10*n* . . . data line
WSL101 to WSL10*m*
DSL111 to DSL11*m* . . . drive line
111 . . . TFT as drive transistor
112 . . . TFT as first switch
113 . . . TFT as second switch
114 . . . TFT as third switch
115 . . . TFT as fourth switch
116 . . . TFT as fifth switch
117 . . . light emitting element
ND111 . . . first node
ND112 . . . second node
ND113 . . . third node
ND114 . . . fourth node

The invention claimed is:

1. A pixel circuit for driving an electro-optic element with a luminance changing according to a flowing current, comprising:

a data line through which a data signal in accordance with luminance information is supplied;

first, second, third, and fourth nodes;

first and second reference potentials;

a pixel capacitance element connected between said first node and said second node;

a coupling capacitance element connected between said second node and said fourth node;

a drive transistor forming a current supply line between said first node and said third node and controlling a current flowing through said current supply line in accordance with a potential of a control terminal of said drive transistor, said control terminal being connected to said second node;

a first switch connected to said third node;

a second switch connected between said second node and said third node;

a third switch connected between said first node and a fixed potential;

a fourth switch connected between said data line and said fourth node; and a fifth switch connected between said fourth node and a predetermined potential;

said first switch, said third node, said current supply line of the drive transistor, said first node, and said electro-optic element being connected in series between said first reference potential and said second reference potential.

2. A pixel circuit as set forth in claim 1, wherein said drive transistor is a field effect transistor with a source connected to said first node and a drain connected to said third node.

3. A pixel circuit as set forth in claim 1, wherein when said electro-optic element is driven, as a first stage, said first switch is held in a conductive state, said fourth switch is held in a non-conductive state, and, in that state, said third switch is held at a conductive state and said first node is connected to a fixed potential;

as a second stage, said second switch and said fifth switch are held in a conductive state, said first switch is held in a non-conductive state, then said second switch and said fifth switch are held in a non-conductive state;

as a third stage, said fourth switch is held in a conductive state, data to be propagated through said data line is input to said fourth node, then said fourth switch is held in a non-conductive state; and as a fourth stage, said third switch is held in a non-conductive state.

4. A pixel circuit as set forth in claim 3, wherein at said third stage, said first switch is held at a conductive state, then said fourth switch is held at a conductive state.

5. A pixel circuit as set forth in claim 1, wherein when said electro-optic element is driven, as a first stage, said first switch and fourth switch are held in a non-conductive state and, in that state, said third switch is held in a conductive state and said first node is connected to a fixed potential;

as a second stage, said second switch and said fifth switch are held in a conductive state, said first switch is held in a conductive state for a predetermined period, then said second switch and said fifth switch are held in a non-conductive state;

as a third stage, said fourth switch is held in a conductive state, data to be propagated through said data line is input to said fourth node, then said fourth switch is held in a non-conductive state; and as a fourth stage, said third switch is held in a non-conductive state.

6. A pixel circuit as set forth in claim 5, wherein at said third stage, said first switch is held at a conductive state, then said fourth switch is held at a conductive state.

7. A pixel circuit as set forth in claim 1, wherein when said electro-optic element is driven, as a first stage, said first switch is held in a conductive state, said fourth switch is held in a non-conductive state, and, in that state, said second switch and said fifth switch are held in a conductive state;

as a second stage, said first switch is held in a non-conductive state, while said third switch is held in a conductive state and said first node is connected to a fixed potential;

as a third stage, said second switch and said fifth switch are held in a non-conductive state;

as a fourth stage, said fourth switch is held in a conductive state, data to be propagated through said data line is input to said fourth node, then said fourth switch is held in a non-conductive state; and as a fifth stage, said first switch is held in a conductive state, while said third switch is held in a non-conductive state.

8. A display device comprising:

a plurality of pixel circuits arranged in a matrix;

a data line arranged for each column of said matrix array of pixel circuits and through which a data signal in accordance with luminance information is supplied; and first and second reference potentials;

each said pixel circuit further having:

an electro-optic element with a luminance changing according to a flowing current, first, second, third, and fourth nodes, a pixel capacitance element connected between said first node and said second node;

a coupling capacitance element connected between said second node and said fourth node;

a drive transistor forming a current supply line between said first node and said third node and controlling a current flowing through said current supply line in accordance with a potential of a control terminal of said drive transistor, said control terminal being connected to said second node;

a first switch connected to said third node;

a second switch connected between said second node and said third node;

a third switch connected between said first node and a fixed potential;

a fourth switch connected between said data line and said fourth node; and a fifth switch connected between said fourth node and a predetermined potential;

said first switch, said third node, said current supply line of the drive transistor, said first node, and said electro-optic element being connected in series between said first reference potential and said second reference potential.

9. A display device as set forth in claim 8, further including a drive device for complementarily holding said first switch at a non-conductive state while holding said third switch at a conductive state in a non-emitting period of said electro-optic element.

10. A method of driving a pixel circuit having:

an electro-optic element with a luminance changing according to a flowing current, a data line through which a data signal in accordance with luminance information is supplied;

first, second, third, and fourth nodes;

first and second reference potentials;

a pixel capacitance element connected between said first node and said second node;

a coupling capacitance element connected between said second node and said fourth node;

a drive transistor forming a current supply line between said first node and said third node and controlling a current flowing through said current supply node; accordance with a potential of a control terminal of said drive transistor, said control terminal being connected to said second node;

a first switch connected to said third node;

a second switch connected between said second node and said third node;

a third switch connected between said first node and a fixed potential;

a fourth switch connected between said data line and said fourth node; and a fifth switch connected between said fourth node and a predetermined potential;

said first switch, said third node, said current supply line of the drive transistor, said first node, and said electro-optic element being connected in series between said first reference potential and said second reference potential, said method of driving a pixel circuit comprising steps of:

holding said first switch in a conductive state, holding said fourth switch in a non-conductive state, and, in that state, holding said third switch in a conductive state, electrically connecting said first node to a fixed potential;

holding said second switch and said fifth switch in a conductive state, holding said first switch in a non-conductive state, then holding said second switch and said fifth switch in a non-conductive state;

holding said fourth switch in a conductive state, inputting data to be propagated through said data line to said fourth node, then holding said fourth switch in a non-conductive state; and holding said third switch in a non-conductive state, electrically separating said first node from said fixed potential.

11. A method of driving a pixel circuit having:

an electro-optic element with a luminance changing according to a flowing current, a data line through which a data signal in accordance with luminance information is supplied;

first, second, third, and fourth nodes;

first and second reference potentials;

a pixel capacitance element connected between said first node and said second node;

a coupling capacitance element connected between said second node and said fourth node;

a drive transistor forming a current supply line between said first node and said third node and controlling a current flowing through said current supply line in accordance with a potential of a control terminal of said drive transistor, said control terminal being connected to said second node;

a first switch connected to said third node;

a second switch connected between said second node and said third node;

a third switch connected between said first node and a fixed potential;

a fourth switch connected between said data line and said fourth node; and a fifth switch connected between said fourth node and a predetermined potential;

said first switch, said third node, said current supply line of the drive transistor, said first node, and said electro-optic element being connected in series between said first reference potential and said second reference potential, said method of driving a pixel circuit comprising steps of:

holding said first switch and fourth switch in a non-conductive state and, in that state, holding said third switch in a conductive state, electrically connecting said first node to a fixed potential;

holding said second switch and said fifth switch in a conductive state, holding said first switch in a conductive state for a predetermined period, then holding said second switch and said fifth switch in a non-conductive state;

holding said fourth switch in a conductive state, inputting data to be propagated through said data line to said fourth node, then holding said fourth switch in a non-conductive state; and holding said third switch in a non-conductive state, electrically separating said first node from said fixed potential.

12. A method of driving a pixel circuit having:

an electro-optic element with a luminance changing according to a flowing current, a data line through which a data signal in accordance with luminance information is supplied;

first, second, third, and fourth nodes;

first and second reference potentials;

a pixel capacitance element connected between said first node and said second node;

a coupling capacitance element connected between said second node and said fourth node;

a drive transistor forming a current supply line between said first node and said third node and controlling a current flowing through said current supply line in accordance with a potential of a control terminal of said drive transistor, said control terminal being connected to said second node;

a first switch connected to said third node;

a second switch connected between said second node and said third node;

a third switch connected between said first node and a fixed potential;

a fourth switch connected between said data line and said fourth node; and a fifth switch connected between said fourth node and a predetermined potential;

said first switch, said third node, said current supply line of the drive transistor, said first node, and said electro-optic element being connected in series between said first reference potential and said second reference potential, said method of driving a pixel circuit comprising steps of:

holding said first switch in a conductive state, holding said fourth switch in a non-conductive state, and, in that state, holding said second switch and said fifth switch in a conductive state;

holding said first switch in a non-conductive state, while holding said third switch in a conductive state, electrically connecting said first node to a fixed potential;

holding said second switch and said fifth switch in a non-conductive state;

holding said fourth switch in a conductive state, inputting data to be propagated through said data line to said fourth node, then holding said fourth switch in a non-conductive state; and holding said first switch in a conductive state, while holding said third switch in a non-conductive state, electrically separating said first node from said fixed potential.

* * * * *